US010751856B2

(12) United States Patent
Emerson

(10) Patent No.: US 10,751,856 B2
(45) **Date of Patent: *Aug. 25, 2020**

(54) STRAIGHT EDGE BAR WITH CLAMP AND SPREADER

(71) Applicant: Eugene Emerson, Whittier, CA (US)

(72) Inventor: Eugene Emerson, Whittier, CA (US)

( * ) Notice: Subject to any disclaimer, the term of this patent is extended or adjusted under 35 U.S.C. 154(b) by 325 days.

This patent is subject to a terminal disclaimer.

(21) Appl. No.: 15/592,145

(22) Filed: May 10, 2017

(65) Prior Publication Data

US 2017/0326707 A1 Nov. 16, 2017

Related U.S. Application Data

(60) Provisional application No. 62/334,420, filed on May 10, 2016.

(51) Int. Cl.

| | |
|---|---|
| ***B25B 5/16*** | (2006.01) |
| ***B25B 1/24*** | (2006.01) |
| ***B25B 1/10*** | (2006.01) |
| ***B25B 1/12*** | (2006.01) |
| ***B25B 5/10*** | (2006.01) |

(52) U.S. Cl.

CPC ..... *B25B 5/166* (2013.01); *B25B 1/103* (2013.01); *B25B 1/125* (2013.01); *B25B 1/2478* (2013.01); *B25B 1/2489* (2013.01); *B25B 5/102* (2013.01)

(58) Field of Classification Search

CPC ..... B25B 5/166; B25B 1/2489; B25B 1/2478; B25B 5/102; B25B 1/103; B25B 1/125

See application file for complete search history.

(56) References Cited

U.S. PATENT DOCUMENTS

| | | | | |
|---|---|---|---|---|
| 4,394,800 | A * | 7/1983 | Griset | B23B 47/287 33/32.3 |
| D272,711 | S * | 2/1984 | Griset | D10/71 |
| 4,490,920 | A * | 1/1985 | Griset | B23B 47/28 33/32.3 |
| 4,499,667 | A * | 2/1985 | Griset | B23B 47/287 33/437 |
| 5,348,276 | A * | 9/1994 | Blacker | B25B 1/08 269/152 |
| 5,722,649 | A * | 3/1998 | Morris | B25B 1/12 269/171 |

(Continued)

*Primary Examiner* — Nimeshkumar D Patel
*Assistant Examiner* — Tania Courson
(74) *Attorney, Agent, or Firm* — John K. Park; Park Law Firm

(57) ABSTRACT

A straight edge bar clamp spreader comprises a straight edge bar, an inner channel portion, parallel channel portions, and two-way bosses or divots, a clamp, and a clamp-spreader. The inner channel portion is provided along an elongated central region of the bottom surface of the straight edge bar with a constant cross-section. The parallel channel portions are provided along two elongated parallel regions of the top surface of the straight edge bar. The two-way bosses or divots are provided across and on an inner surface of the inner channel portion of the bottom surface and an outer surface of the top surface and configured to define the predetermined stopping positions for two-way movements along the bottom surface or the top surface. The clamp is installed in the inner channel portion of the bottom surface. The clamp-spreader is installed in the pair of parallel channel portions of the top surface.

18 Claims, 24 Drawing Sheets

(56) References Cited

U.S. PATENT DOCUMENTS

| | | | | |
|---|---|---|---|---|
| 6,622,997 | B2 * | 9/2003 | Emerson | B25B 1/08 269/164 |
| 7,114,715 | B1 * | 10/2006 | Kirk | B25B 5/068 269/147 |
| 7,165,334 | B2 * | 1/2007 | Ben-Gigi | B25H 1/0078 33/443 |
| 7,484,306 | B2 * | 2/2009 | Emerson | B25B 1/2489 33/403 |
| 9,283,659 | B2 * | 3/2016 | Emerson | B25B 5/10 |
| 9,815,177 | B2 * | 11/2017 | Ursell | B25B 5/166 |
| 9,975,221 | B2 * | 5/2018 | Ursell | B25B 5/166 |
| 10,478,947 | B2 * | 11/2019 | Ursell | B25B 5/085 |
| 2007/0125040 | A1 * | 6/2007 | Emerson | B25B 1/2489 52/750 |
| 2014/0300042 | A1 * | 10/2014 | Ursell | B25B 1/08 269/149 |
| 2018/0264631 | A1 * | 9/2018 | Ursell | B25B 5/166 |
| 2018/0272500 | A1 * | 9/2018 | Ursell | B25B 1/08 |

* cited by examiner

– Prior Art –

-- Prior Art --

-- Prior Art --

"CLAMP - SPREADER side"

STRAIGHT EDGE BAR WITH CLAMP AND SPREADER

RELATED APPLICATION

This application is a Non-provisional Application of Provisional Application Ser. No. 62/334,420 for "Straight Edge Bar with Clamp and Spreader" filed on May 10, 2016.

BACKGROUND OF THE INVENTION

The present invention relates to a straight edge bar with clamp and spreader. More particularly, this invention relates to a straight edge bar piece combined with a clamp and a spreader, which improves the features of conventional bar clamp.

An extrusion cross-section for a straight edge clamping device and a straight edge clamp were disclosed and taught in U.S. patent application Ser. No. 12/987,825 filed Jan. 10, 2011 (patented as U.S. Pat. No. 8,230,611) and U.S. patent application Ser. No. 14/256,783 filed Apr. 18, 2014 (patented as U.S. Pat. No. 9,283,659), respectively, by the Applicant.

However, the present application contrives to solve the problems or disadvantages of the prior art.

Accordingly, a need for a straight edge bar with clamp and spreader has been present for a long time considering the expansive demands in the everyday life. This invention is directed to solve these problems and satisfy the long-felt need.

SUMMARY OF THE INVENTION

The present invention contrives to solve the disadvantages of the prior art.

An object of the invention is to provide a straight edge bar with clamp and spreader.

A straight edge bar clamp spreader comprises a straight edge bar, an inner channel portion, a pair of parallel channel portions, a plurality of two-way bosses or divots, a clamp, and a clamp-spreader.

The straight edge bar comprises an elongated channeled bar having a first end, a second end, a bottom surface, and a top surface.

The inner channel portion is provided along an elongated central region of the bottom surface of the straight edge bar with a constant cross-section.

The pair of parallel channel portions are provided along two elongated parallel regions of the top surface of the straight edge bar with a constant cross-section.

The plurality of two-way bosses or divots are provided across and on an inner surface of the inner channel portion of the bottom surface and an outer surface of the top surface and configured to define the plurality of predetermined stopping positions for two-way movements along the inner surface of the bottom surface or the outer surface of the top surface.

The clamp is installed in the inner channel portion of the bottom surface.

The clamp-spreader is installed in the pair of parallel channel portions of the top surface.

The clamp and the clamp-spreader are configured to work independently from each other in sliding and locking.

The clamp comprises a threaded base, a first movable jaw body, a catching device, a second movable jaw body, and a threaded shaft.

The threaded base is installed fixedly partially in the channel of the bottom surface of the elongated channeled bar at the first end of the straight edge bar.

The first movable jaw body is installed movably and partially in the channel of the bottom surface of the elongated channeled bar at a plurality of predetermined positions along the straight edge bar, and the plurality of two-way bosses or divots are configured to define the plurality of predetermined stopping positions for the first movable jaw.

The catching device is provided in the first movable jaw body and configured to be engaged by or released from one or more of the plurality of two-way bosses or divots.

The second movable jaw body is installed partially in the channel of the bottom surface of the elongated channeled bar movably between the threaded base and the first movable jaw body along the bottom surface of the elongated channeled bar.

The threaded shaft is disposed in parallel with the straight edge bar and configured to be supported through the threaded base and anchored rotate-ably at the second movable jaw body so as to move the second movable jaw body parallel to and along the straight edge bar, so as to exert a clamping force when engaged with a work piece between the moveable jaws.

The bottom surface of the straight edge bar further comprises a flat top portion, straight edge portions, a flat bottom portion, capturing channel(s), and overhanging portion(s).

The capturing channel(s) is provided between the flat top portion and the flat bottom portion and configured inside the inner channeled portion on the bottom surface of the straight edge bar to capture and prevent the threaded base, the first movable jaw body, and the second movable jaw body from being lifted out of the inner channeled portion of the bottom surface.

Each of the overhanging portion(s) may be provided at an inner edge of the flat bottom portion and defining a wall of the corresponding capturing channel.

The catching device may comprise a pawl, which is configured to be stopped at a catching position so as to be stopped by one or more of the two-way bosses or divots or to be lifted up by a lifted distance larger than a predetermined magnitude so as to clear the two-way bosses or divots and allow the first movable jaw body to slide along the bottom surface of the straight edge bar.

Each boss may protrude from the inner surface of the inner channel portion sufficiently to catch the pawl of the catching device, or each divot may be a hollow spot on the inner channel portion of sufficient depth to catch the pawl of the catching device.

The threaded base may comprise an outer portion and an inner portion, and the outer portion may extend below the flat bottom portion, and the inner portion may be disposed and fixed in the channeled portion of the channeled bar, surrounded by the flat top portion, the capturing channel(s), and the overhanging portion(s).

The threaded shaft may comprise a screw portion supported by a matching threaded screw hole provided through the threaded base.

The threaded shaft may further comprise a handle portion disposed at an end of the screw portion, which is farthest from the second jaw body.

Each of the first and second movable jaw bodies my comprise an outer portion and an inner portion, wherein the outer portion extends below the flat bottom portion, and the inner portion may be disposed slide-ably in the channeled portion of the channeled bar, surrounded by the flat top portion, the capturing channel(s), and the overhanging portion(s).

The threaded shaft may be disposed partially inside, entirely inside, or entirely outside the straight edge bar.

Each of the plurality of bosses or divots may protrude on the bottom surface and embosses on the top surface, and the threaded base may comprise a latching groove provided on a bottom side of the threaded base and configured to be latched by one of the plurality of bosses or divots, and the catching device may comprise an one-way latching groove provided on a bottom side of the threaded base and configured to be latched by one of the plurality of bosses or divots.

Each of the plurality of bosses or divots may protrude on the top surface and embosses on the bottom surface, and the threaded base may comprise a latching protrusion provided on a bottom side of the threaded base and configured to be latched by one of the plurality of bosses or divots, and the catching device may comprise an one-way latching protrusion provided on a bottom side of the threaded base and configured to be latched by one of the plurality of bosses or divots.

The clamp-spreader may comprise a base block and a pushing block.

The base block comprises a first vertical surface portion, a second vertical surface portion, a pair of guiding protrusions, and a latching portion, wherein each of the pair of guiding protrusions is configured to be received and guided by one of the pair of parallel channel portions, and the latching portion is configured to be received and latched by one of the plurality of two-way bosses or divots.

The pushing block comprises a third vertical surface portion, a pair of guiding protrusions, and a catching device, and each of the pair of guiding protrusions is configured to be received and guided by one of the pair of parallel channel portions, and the catching device is provided in the pushing block and configured to be engaged by or released from one of the plurality of two-way bosses or divots.

Each of the first and second vertical surface portions is configured to be used to engage a work piece with the third vertical surface portion.

The catching device may comprise a pawl, which is configured to be stopped at a catching position so as to be stopped by one or more of the two-way bosses or divots or to be lifted up by a lifted distance larger than a predetermined magnitude so as to clear the two-way bosses or divots and allow the pushing block to slide along the top surface of the straight edge bar.

The pair of guiding protrusions of the pushing block and the catching device may be configured so that the pushing block is disposed in both directions with the third vertical surface portion disposed inwards or outwards.

The pair of guiding protrusions of the base block and the latching portion may be configured so that the base block is disposed in both directions with the first or second vertical surface portion disposed inwards.

In certain embodiments of the invention, the clamp-spreader may further comprise: a threaded base disposed on the top surface of the elongated channeled bar at the first end of the straight edge bar; and a threaded shaft disposed in parallel with the straight edge bar and configured to be supported through the threaded base and anchored rotateably at the base block so as to move the base block parallel to and along the straight edge bar, so as to exert a clamping force when engaged with a work piece between the base block and the pushing block.

In certain embodiments of the invention, the threaded base and the base block connected to each other through the threaded shaft may be configured to be disposed in a reverse direction and the pushing block may be configured to be disposed in the reverse direction, so as to form a clamp.

In certain embodiments of the invention, the threaded base and the second movable jaw body connected to each other through the threaded shaft may be configured to be disposed in a reverse direction and the first movable jaw body may be configured to be disposed in the reverse direction, so as to form a spreader.

Each of the plurality of two-way bosses or divots may comprise two stopping steps configured for stopping the catching device of the clamp or the spreader on the bottom surface or the top surface, respectively.

The advantages of the present invention are: (1) the straight edge bar with clamp and spreader according to the invention is simple in structure; and (2) the straight edge bar with clamp and spreader improves the usefulness of a bar clamp.

Especially, as the straight edge bar with clamp and spreader can perform three functions.

1) Functions as a straight edge clamp, because the jaw bodies are inside the bar, the outside straight edge of the bar can be used to guide a tool. Note, the prior art cannot be used as a straight edge, as the jaw bodies interrupt the contiguous straight edge of the bar, as they wrap around the outside of the bar.

2) Functions as a bar clamp, where the usability of the bar clamp is greatly improved, as in the present invention the bar can rest directly on a work bench, with easy stability, as the jaw bodies are inside the bar, rather than resting on the jaw bodies as the prior art must.

3) Functions also as a spreader.

4) Each of structures on both side can be configured to work as a clamp or spreader.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

All the disclosure of an extrusion cross-section for a straight edge clamping device and a straight edge clamp disclosed and taught in U.S. patent application Ser. No. 12/987,825 filed Jan. 10, 2011 (patented as U.S. Pat. No. 8,230,611) and U.S. patent application Ser. No. 14/256,783 filed Apr. 18, 2014 (patented as U.S. Pat. No. 9,283,659), respectively, by the Applicant have been incorporated by reference.

FIGS. 1-6 show a straight edge bar clamp according to the prior art disclosed in U.S. patent application Ser. No. 14/256,783.

Figure 1:
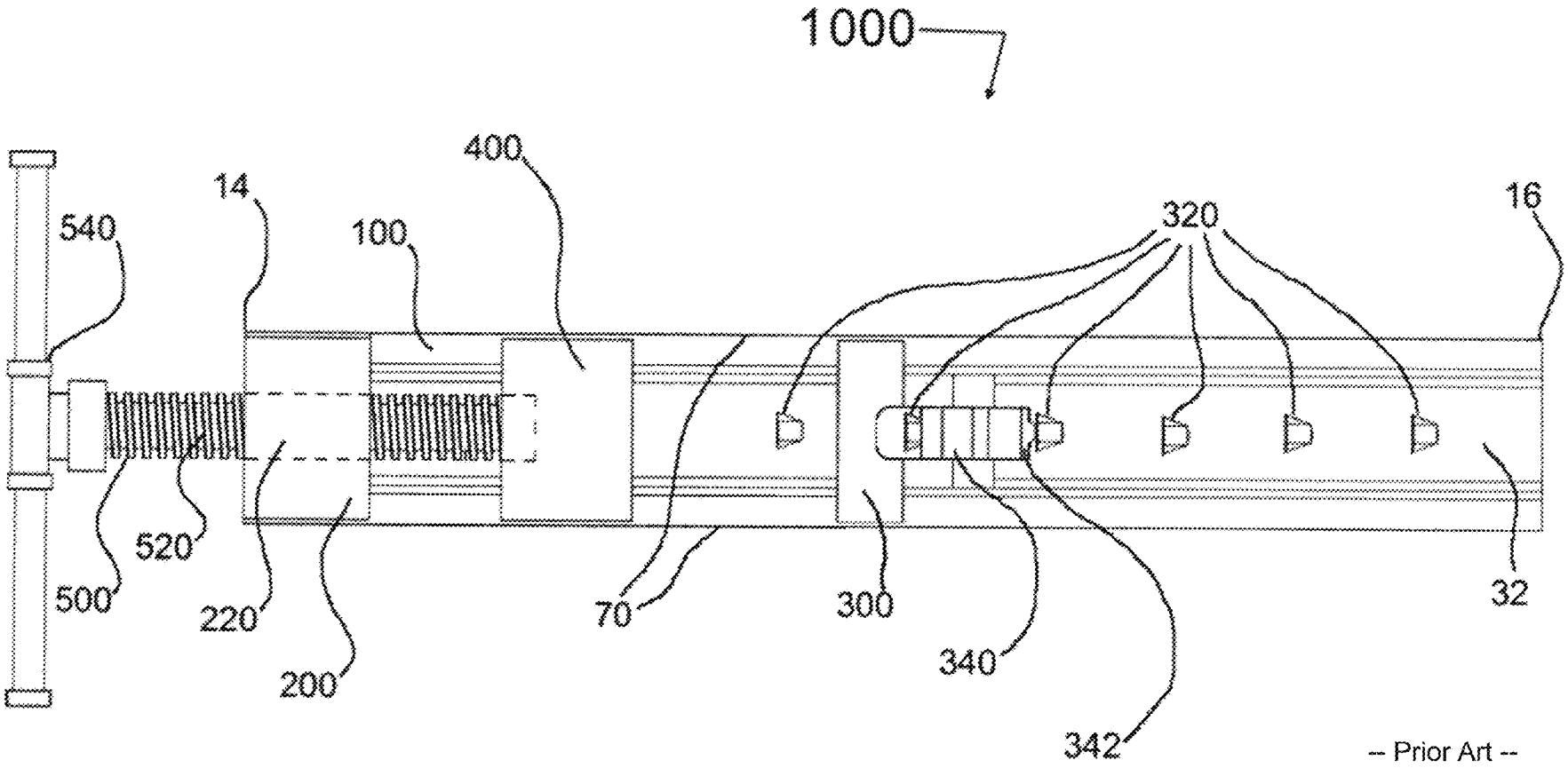
FIG. 1 is a top plan view showing a straight edge bar clamp according to prior arts.

In FIG. 1, each of the threaded base, the first movable jaw body, and the second movable jaw body is installed in the inner channel portion of the straight edge bar clamp just like in U.S. patent application Ser. No. 14/256,783. In the illustrated embodiment, the threaded shaft is omitted for showing the other components more clearly. Each of the divots has a shape ensuring two-way stop, in the sense that the divot protrudes on the bottom side of the straight edge bar as in FIGS. 1 and 2 and at the same time it embosses on the top side of the straight edge bar as in FIGS. 3 and 4, so that it can be used for stopping jaw body or blocks independently. In the illustrated embodiment, the divot has a shape of truncated cylinder, but it is not limiting. It may have a rectangular shape, too. Alternatively, the shape of the illustrated divot can be seen to have a trapezoidal cross-section.

Figure 2:
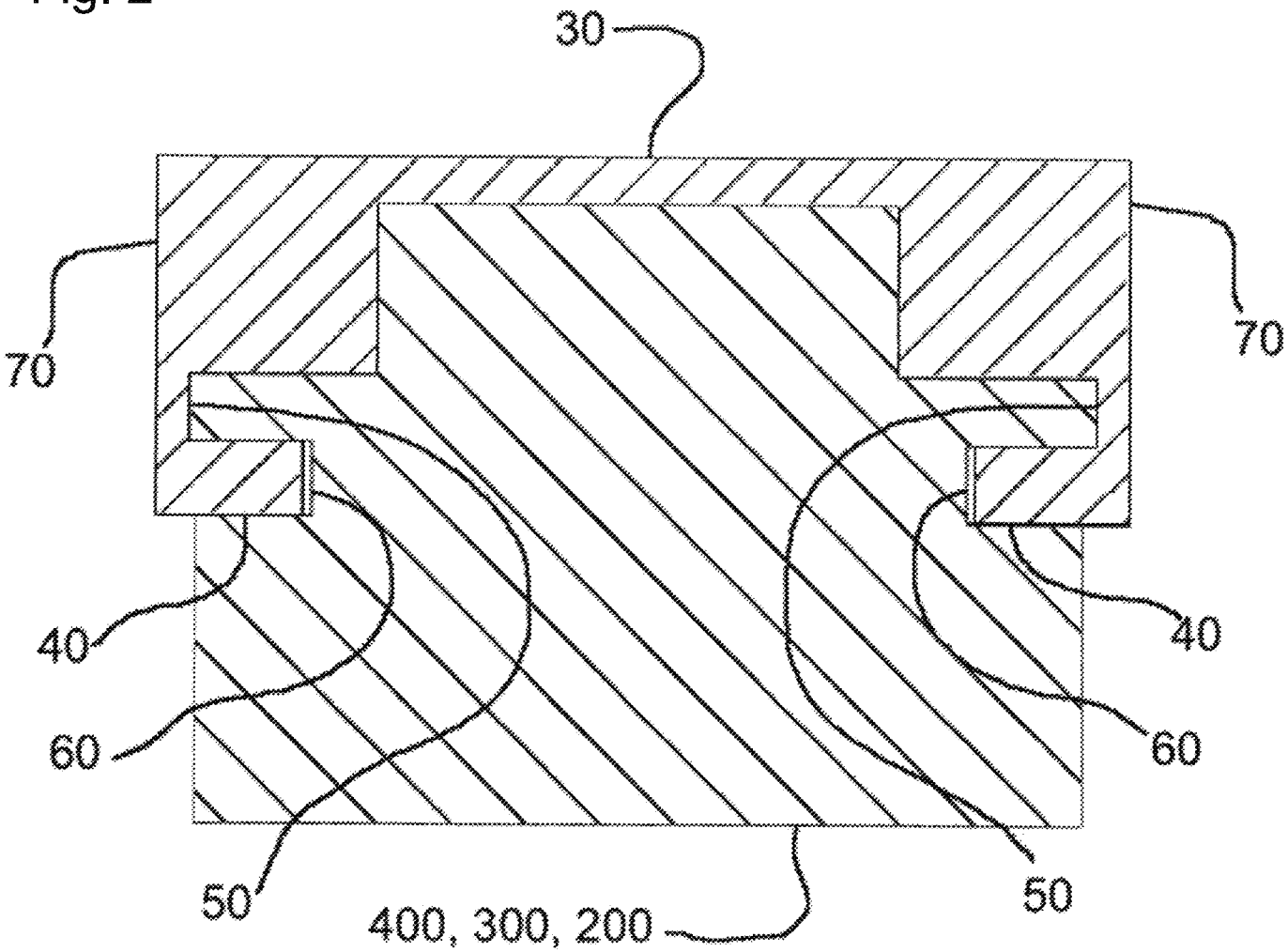
FIG. 2 is a cross-sectional view showing a straight edge bar clamp according to prior arts.

In FIG. 2, the threaded base has a latching groove that is blocked at one side. That is, the protrusion of the divot is received in the latching groove and its sliding motion is blocked or stopped by the blocking barrier provided at the one side. Of course, the threaded base may be fixed to the bottom of the straight edge bar by other fastening means such as screws and the like. The threaded base may be installed at the end of the straight edge bar with the blocking barrier is disposed so as to be latched at an outer edge of the last divot.

Figure 3:
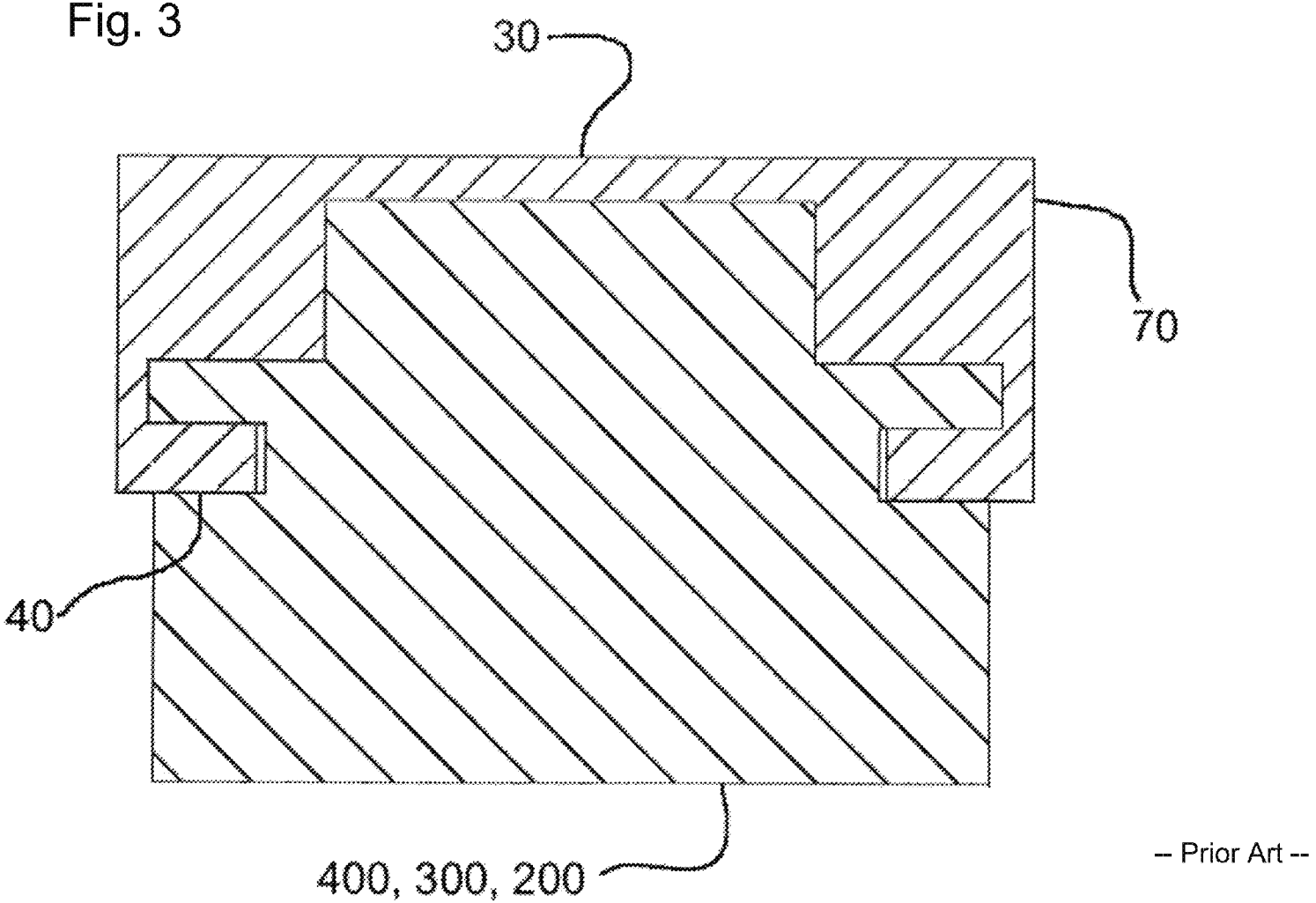
FIG. 3 is another cross-sectional view showing a straight edge bar clamp according to prior arts.
Figure 12:
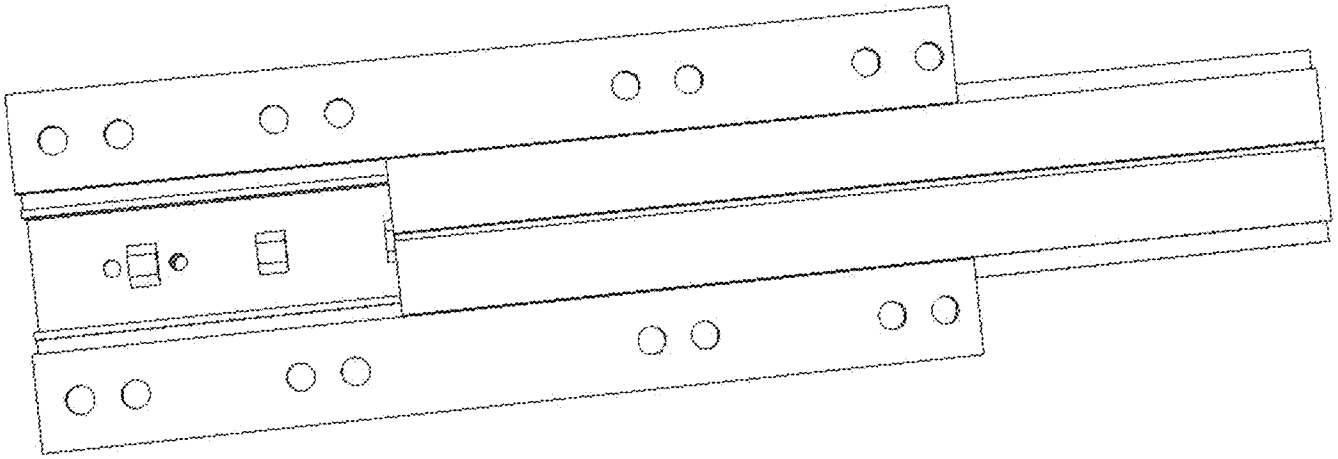
FIG. 12 is a perspective view showing a connector installed in an inner channel portion on the bottom of a straight edge bar according to an embodiment of the invention.
Figure 13:
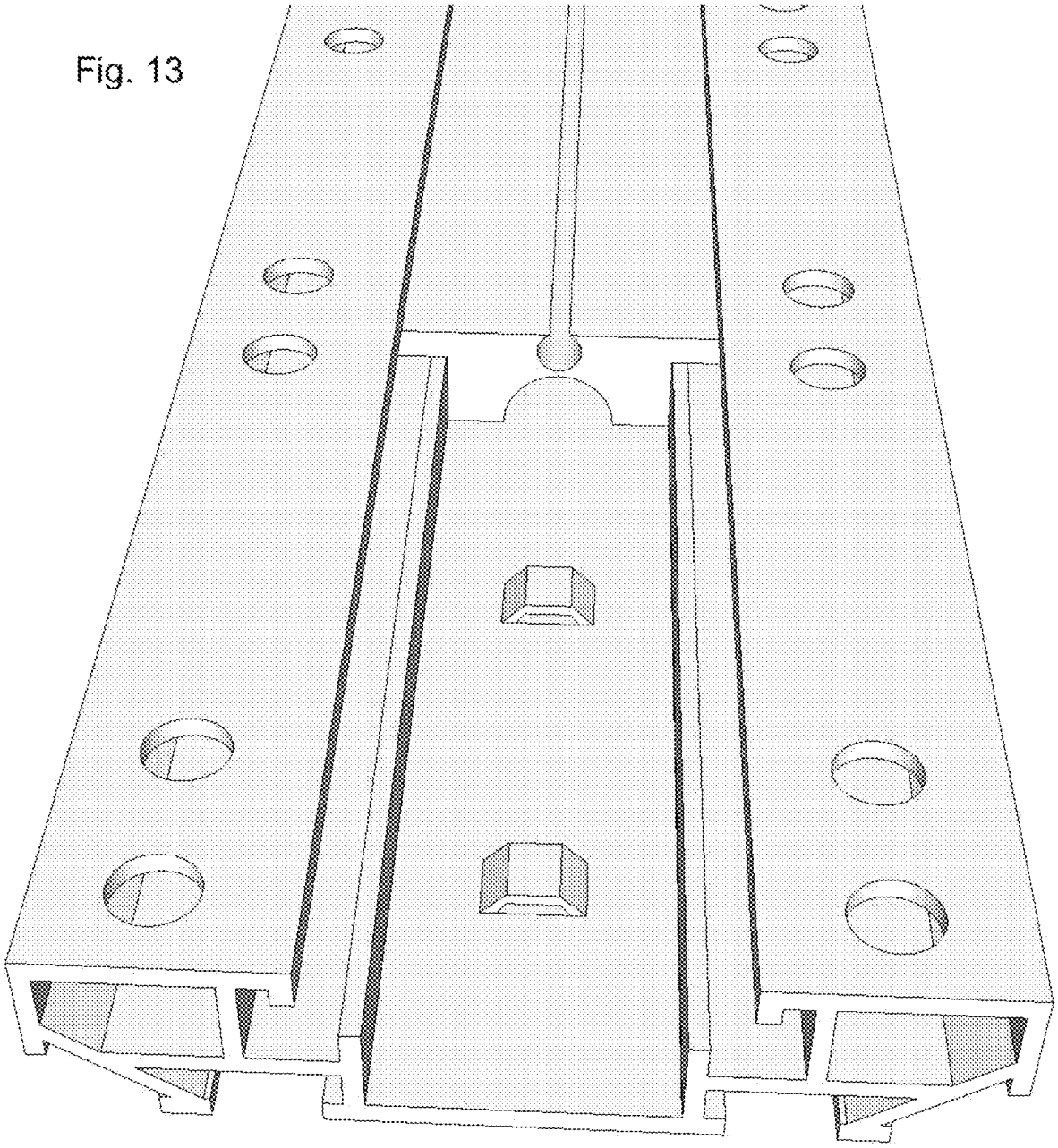
FIG. 13 is another perspective front view showing the connector of FIG. 12.
Figure 14:
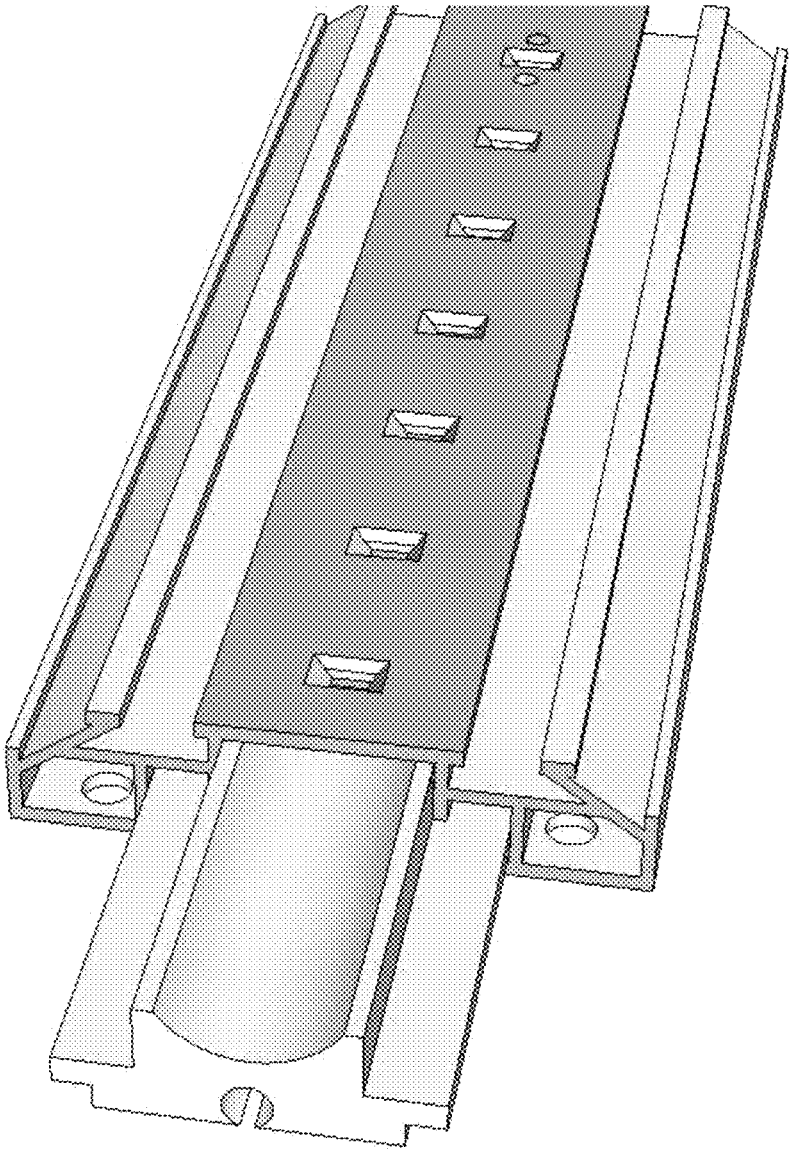
FIG. 14 is another perspective rear view showing the connector of FIG. 12.
Figure 15:
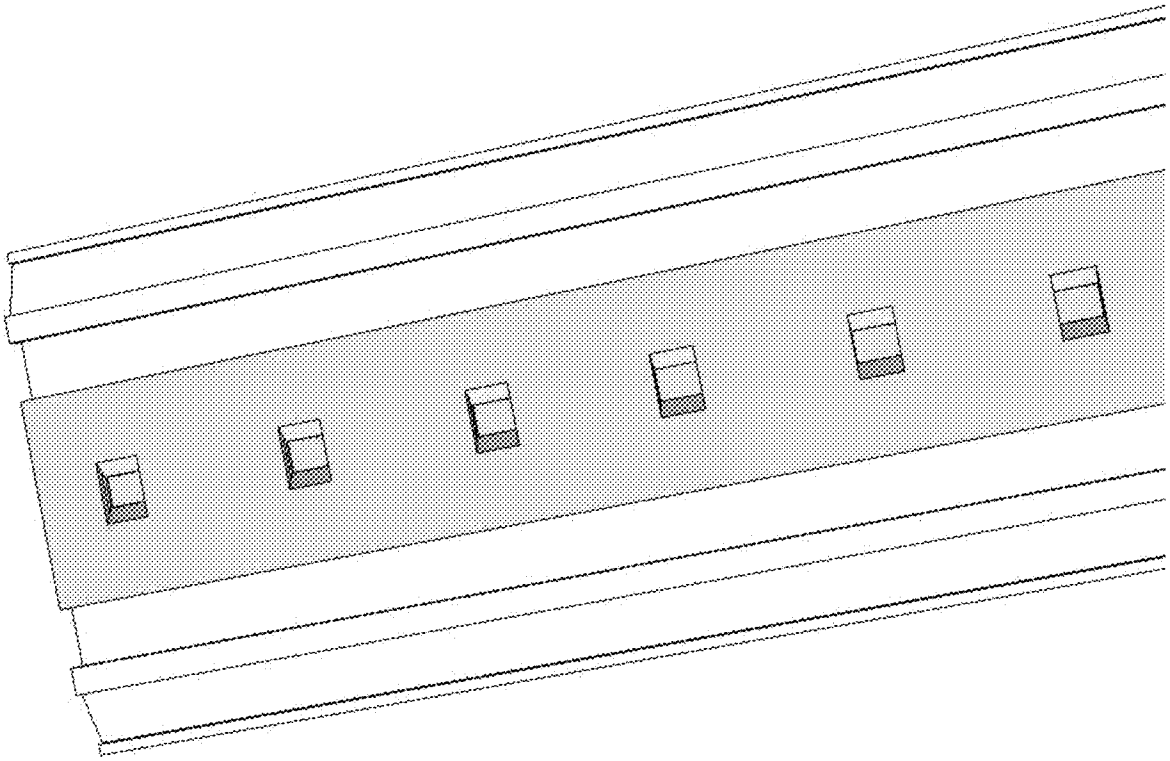
FIG. 15 is a perspective view showing a top of a straight edge bar according to an embodiment of the invention.
Figure 16:
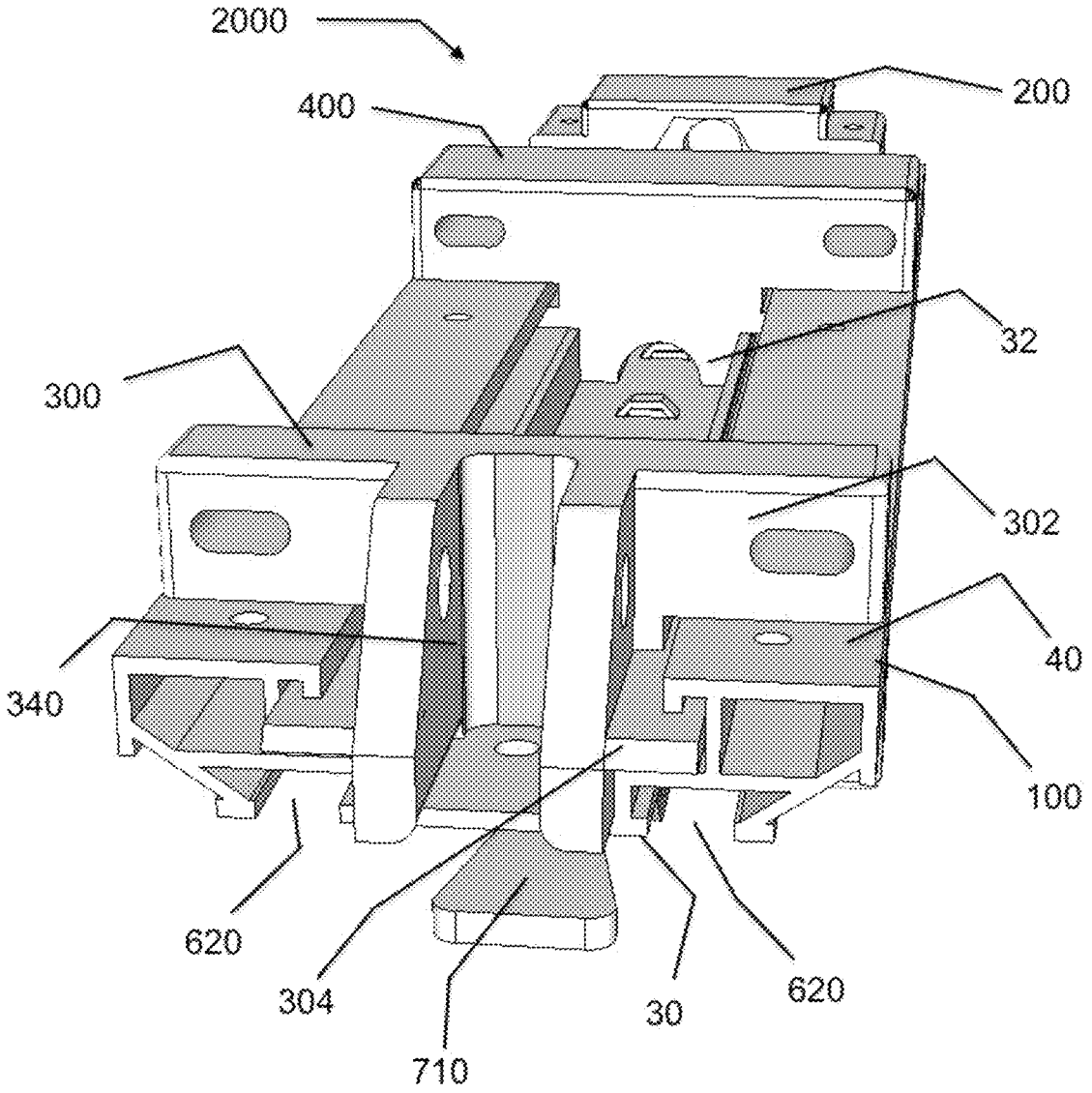
FIG. 16 is another perspective view showing a clamp on the bottom of the straight edge bar of FIG. 7.
Figure 17:
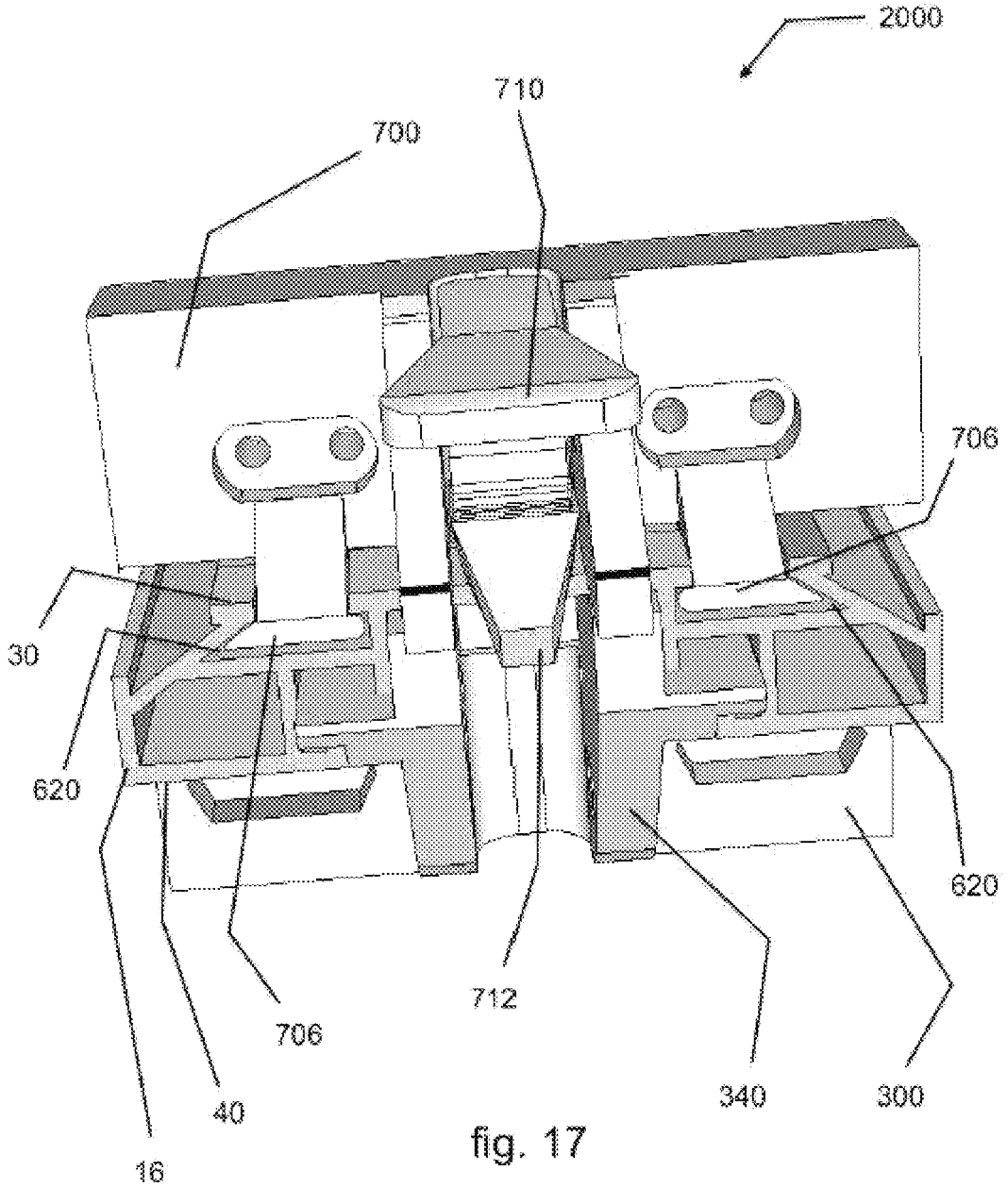
FIG. 17 is a rear view showing the straight edge bar clamp spreader according to an embodiment of the invention.
Figure 18:
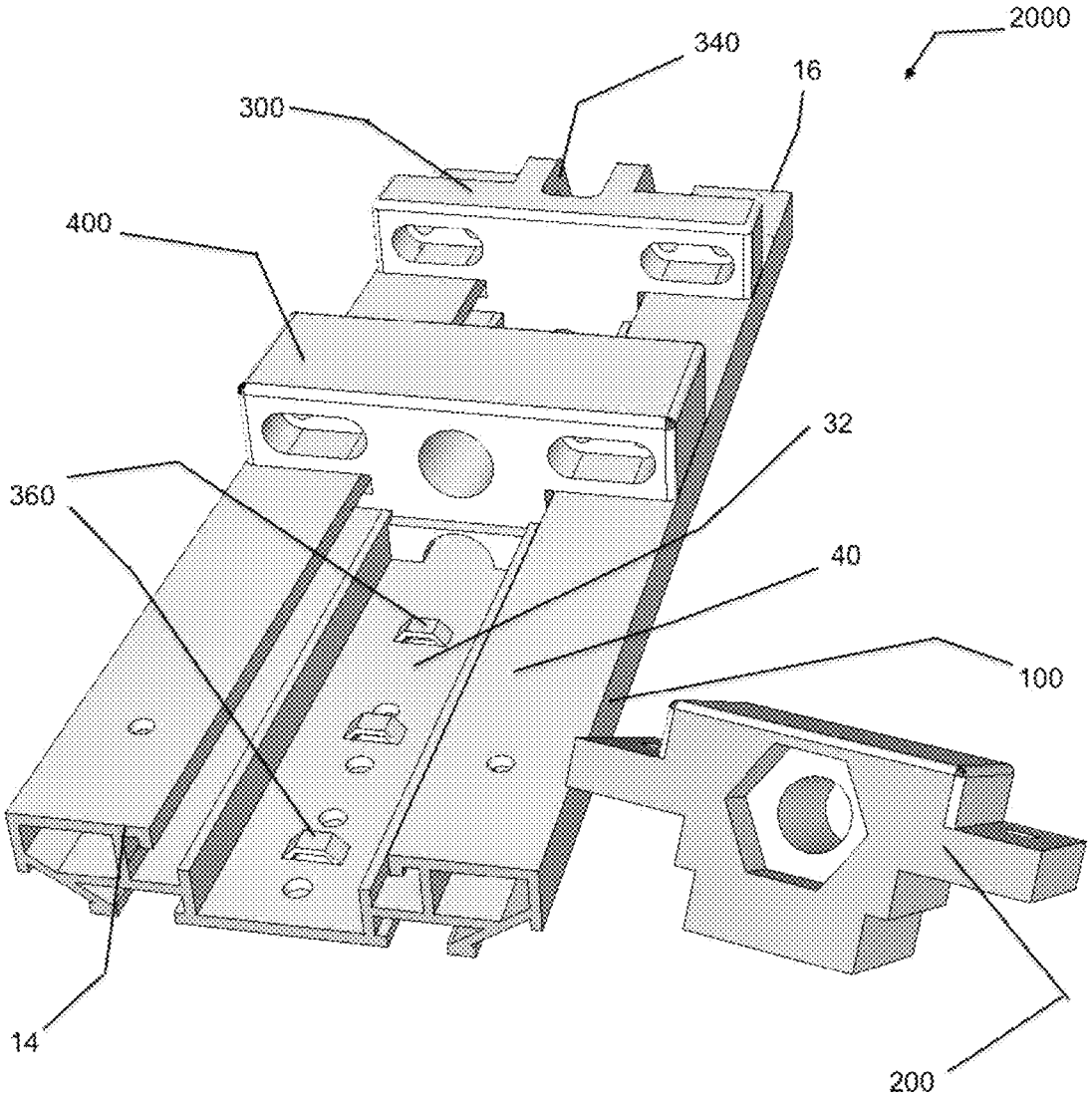
FIG. 18 is another perspective view of the clamp-spreader with the threaded base disassembled.

In FIG. 3, each of the base block and the pushing block is installed in the pair of parallel channel portions at the top of the straight edge bar slidably. FIG. 12 shows the thread hole clearly through the threaded base.

Figure 4:
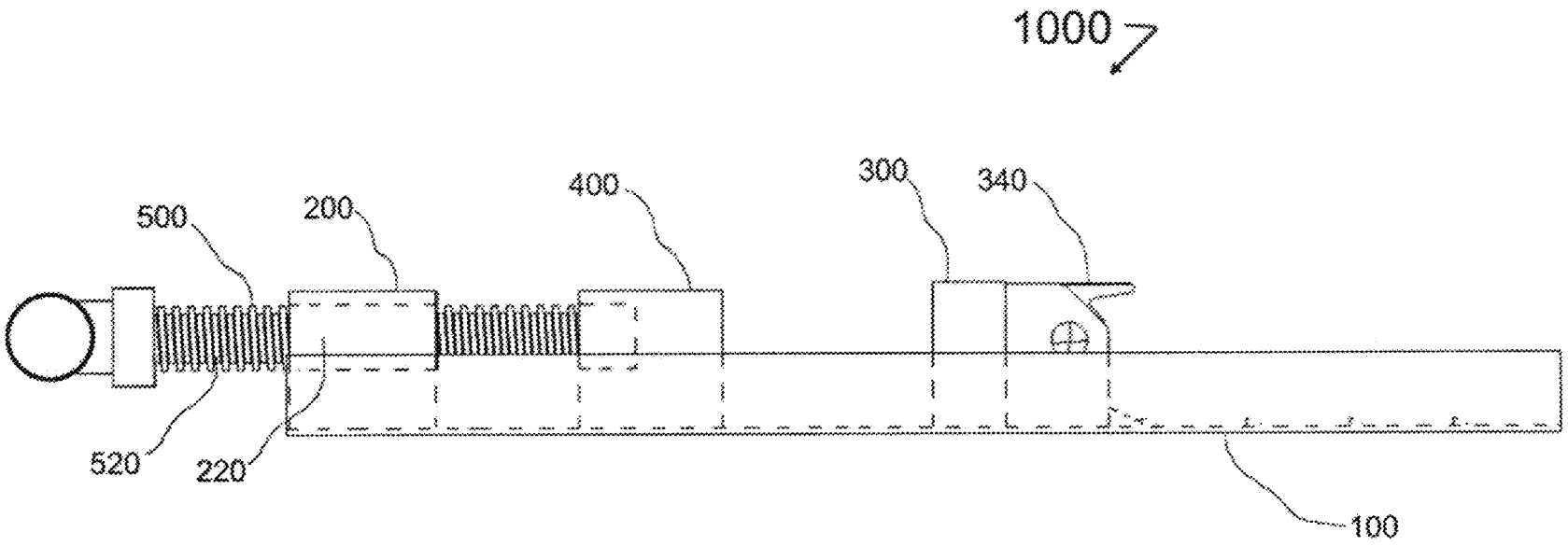
FIG. 4 is a side view showing a straight edge bar clamp according to prior arts.

In FIG. 4, it can be seen how the groove of the divot is latched to the corresponding latching portion (protrusion). The pair of guiding protrusion may be provided, but as illustrated they can be omitted.

Figure 5:
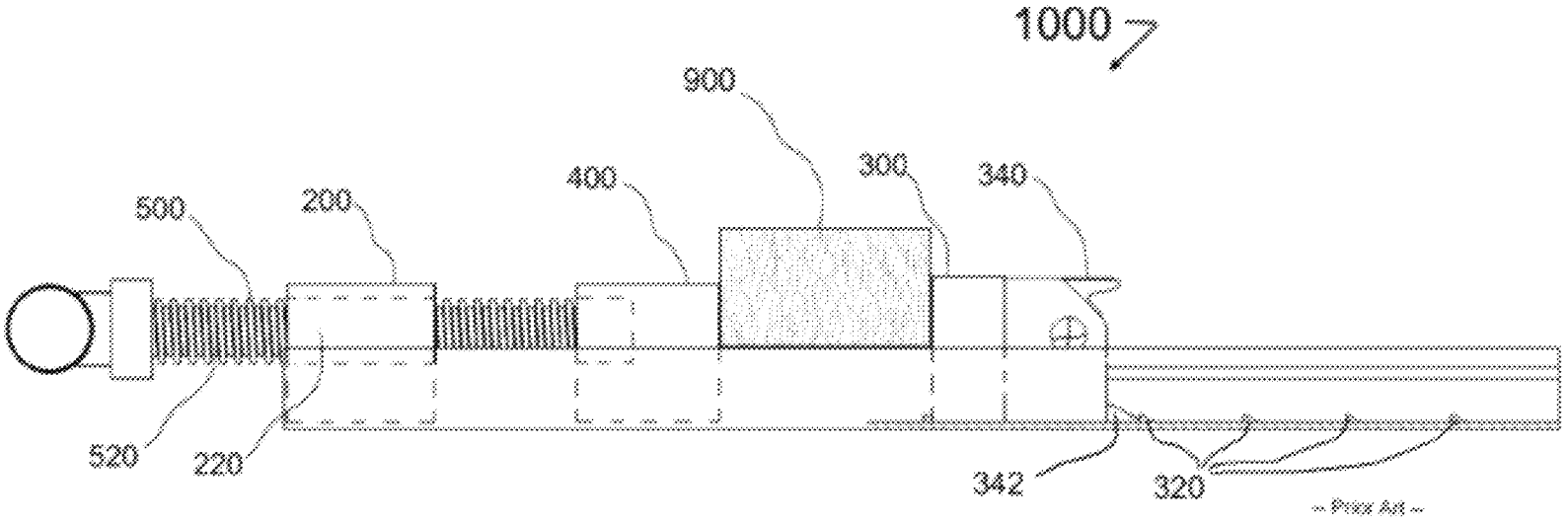
FIG. 5 is another side view showing a straight edge bar clamp used as a bar clamp according to prior arts.
Figure 11:
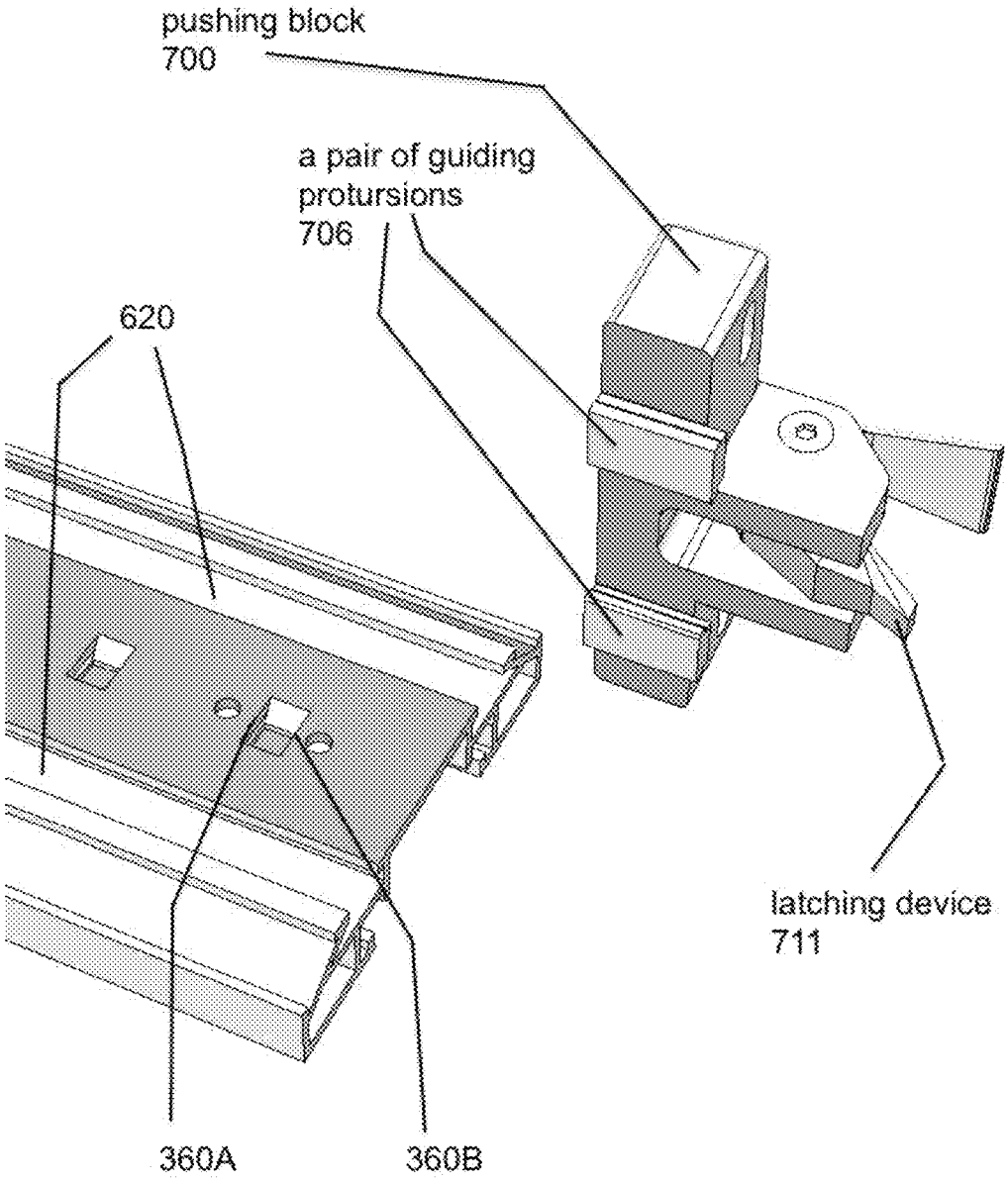
FIG. 11 is another perspective view showing the clamp-spreader of FIG. 9 with the pushing block disassembled according to an embodiment of the invention.

In FIGS. 5 and 11, the pair of guiding protrusions provided on the bottom portion of the pushing block can be caught in the pair of parallel channel portions as illustrated. The pushing block can be turn around and can engage the top of the straight edge bar in the opposite direction.

Figure 10:
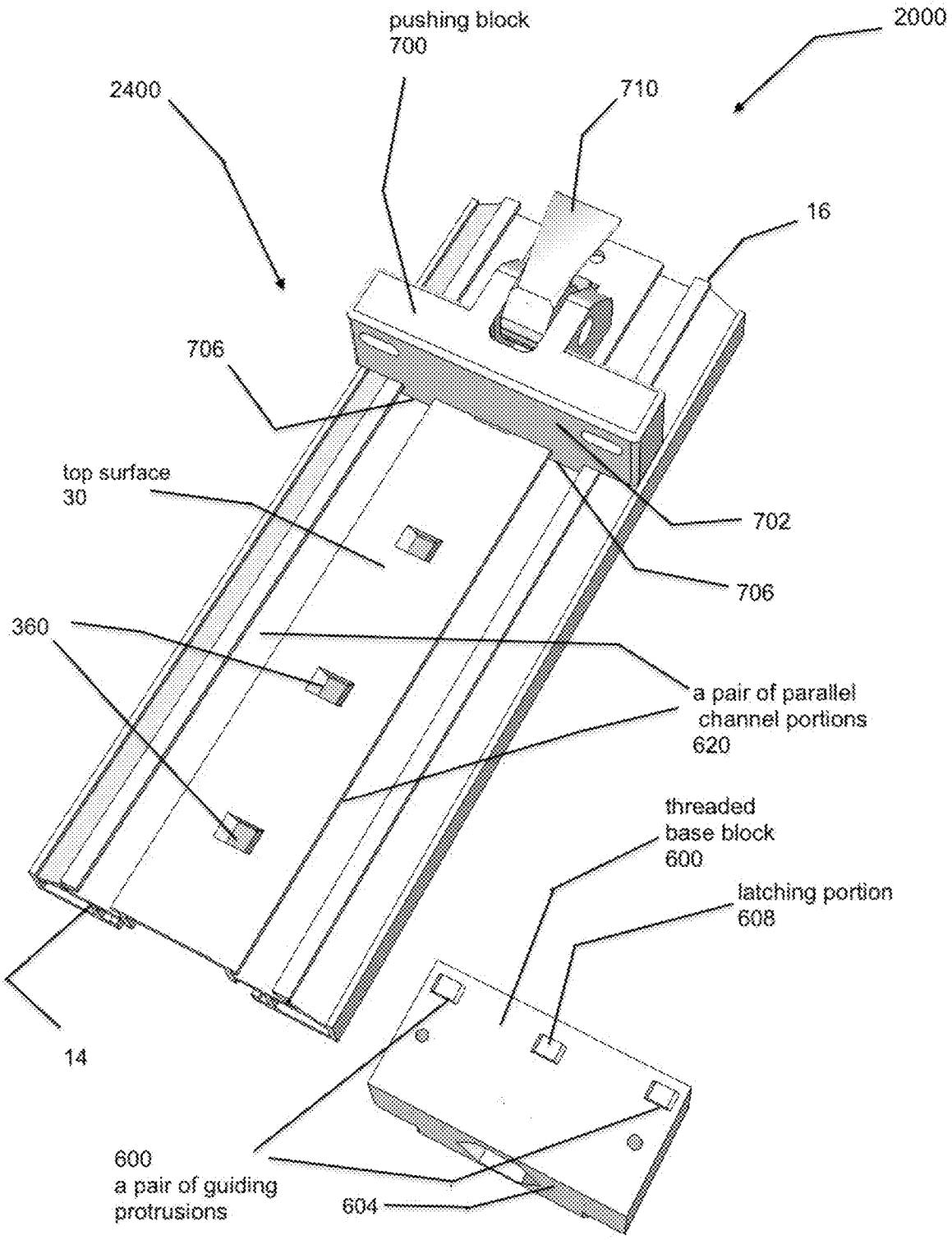
FIG. 10 is another perspective view showing the clamp-spreader of FIG. 9 with the base block disassembled according to an embodiment of the invention.

In FIG. 10, the first or second movable jaw body has a cross-sectional structure to be caught in the inner channel portion as in U.S. patent application Ser. No. 14/256,783. The first movable jaw body can have a latching groove with a blocking barrier just as in the threaded base. That way, the first movable jaw body can be positioned anywhere along the bottom of the straight edge bar with a vertical surface facing inwards, so that a work piece is clamped between the first and second movable jaw bodies.

In FIGS. 6-9, the connector (blue element) can engage two straight edge bars (only one is shown), so as to connect the two straight edge bars.

Figure 8:
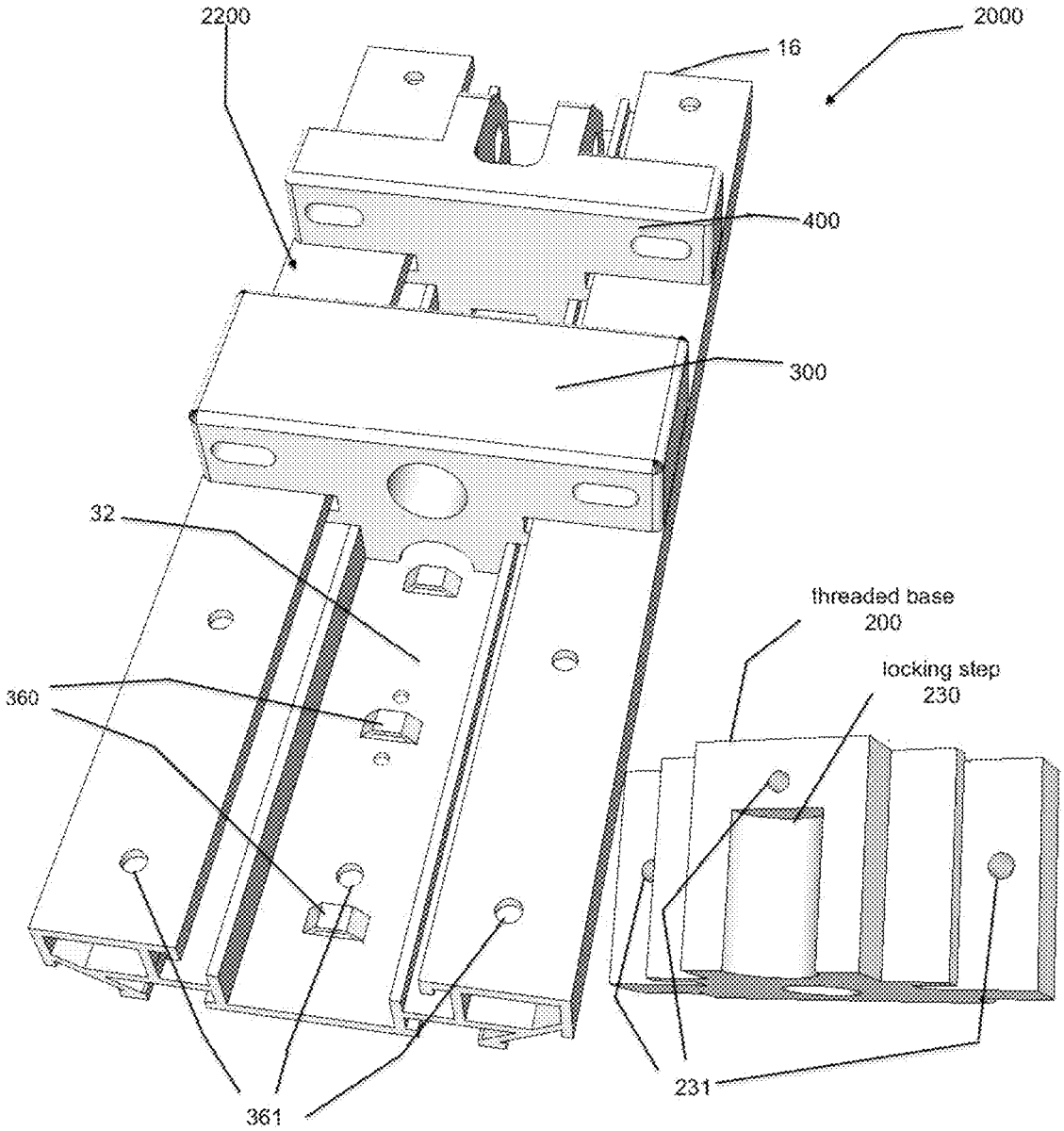
FIG. 8 is another perspective view showing the clamp of a straight edge bar clamp spreader of FIG. 7 with a threaded base disassembled according to an embodiment of the invention.

For the clamp structure of the invention, FIGS. 1-5 of U.S. patent application Ser. No. 14/256,783 can be referred as follows. As can be seen in FIG. 8, the connector has a cross-sectional structure suitable to be caught in the inner channel portion, especially under the overhang portions of the straight edge bar.

A straight edge bar clamp 1000 comprises an elongated channeled bar 100, a threaded base 200, a first movable jaw body 300, a plurality of bosses or divots 320, a catching device 340, a catching pawl 342, a second movable jaw body 400, and a threaded shaft 500.

The straight edge bar 100 comprises an elongated channeled bar 100 having an inner channel portion 32 and a constant cross-section, and also the straight edge bar 100 comprises a first end 14 and a second end 16. The inner channel portion 32 also comprises two side channels and a pair of overhanging portions, each of which (the overhanging portion) being at an inner edge of the flat bottom portion and defining one wall of the adjacent side channel.

The threaded base 200 is installed fixedly partially in the elongated channeled bar 100 in the channel 32 at the first end 14 of the straight edge bar 100.

The first movable jaw body 300 is installed slide-ably partially in the channel 32 of the elongated channeled bar 100, surrounded by the flat top portion 30, the capturing channel(s) 50, and the overhanging portion(s) 60, at a plurality of predetermined positions along the length of the bar from the second movable jaw to a point toward the second end 16 of the straight edge bar 100.

The plurality of bosses or divots 320 are provided on an inner surface of the inner channel portion 32 and configured to define the plurality of predetermined positions where the first movable jaw body 300 may stop.

The catching device 340 is provided in the first movable jaw body 300 and configured to be stopped when engaged, by one or more of the plurality of bosses or divots 320 and, to pass by when disengaged, so as to allow positioning to another one of the plurality of the bosses or divots 320.

The second movable jaw body 400 installed partially in the channeled portion of the elongated channeled bar 100, surrounded by the flat top portion, the capturing channel(s), and the overhanging portion(s), slide-ably between the threaded base 200 and the first movable jaw body 300 along the elongated channeled bar 100.

The threaded shaft 500 is disposed to be in parallel with the straight edge bar 100 and configured to be supported through the threaded base 200 and anchored rotate-ably in the second movable jaw body 400 so as to move the second movable jaw body 400 parallel to and along the straight edge bar 100, so as to position the second movable jaw, but also to exert a clamping force when engaged with a work piece 900 between the moveable jaws.

The straight edge bar 100 may further comprise a flat top portion 30, a straight edge portion(s) 70, a flat bottom portion 40, capturing channel(s) 50, and a pair of overhanging portions 60.

The capturing channel(s) 50 are provided between the flat top portion 30 and the flat bottom portion 40, and inside the channel portion 32 disposed to be configured to capture and prevent the threaded base 200, the first movable jaw body 300, and the second movable jaw body 400 from coming out of the channel as shown in FIGS. 2 and 3.

Each of the overhanging portion(s) 60 is provided at an inner edge of the flat bottom portion 40 and defines the lower wall of the adjacent capturing channel 50.

The catching device 340 may comprise a pawl 342, which is configured to be stopped at a catching position so as to be stopped by one or more of the bosses or divots 320 or to be lifted up by a lifting distance larger than a predetermined magnitude so as to clear the boss or divot to allow the first movable jaw body 300 to slide along the straight edge bar 100.

Each boss or divot 320 may protrude from the inner surface of the inner channel portion 32, or each divot 320 may be a hollow spot on the inner channel portion 32, of the straight edge bar 100.

The threaded base 200 may comprise an outer portion and an inner portion. The outer portion extends below the flat bottom portion 40, and the inner portion is disposed, to be fixed, in the channel 32 surrounded by the flat top portion 30, the capturing channel(s) 50, and the overhanging portion(s) 60.

The threaded shaft 500 may comprise a screw portion 520 supported by a screw hole 220 provided through the threaded base 200.

The threaded shaft 500 may further comprise a handle portion 540 disposed at the end of the screw portion 520 farthest from the second movable jaw 400.

Each of the first and second movable jaw bodies 300, 400 may comprise an outer portion and an inner portion. The outer portion extends below the flat bottom portion 40, and the inner portion is disposed slide-ably within the inner channel portion 32 of the channeled straight edge bar 100.

The threaded shaft 500 may be disposed partially inside, entirely inside, or entirely outside the straight edge bar as shown in FIG. 3. The screw hole 220 may be disposed accordingly.

Referring to FIG. 4, the screw portion 520 of the thread shaft 500 is disposed such that a part thereof is positioned above the flat bottom portion 40. The threaded structure of the hole 220 and the rotate-able structure of the threaded shaft 500 is well known to the public.

Referring to FIG. 5, the straight edge bar clamp 1000 is engaged on a work piece 900.

Figure 6:
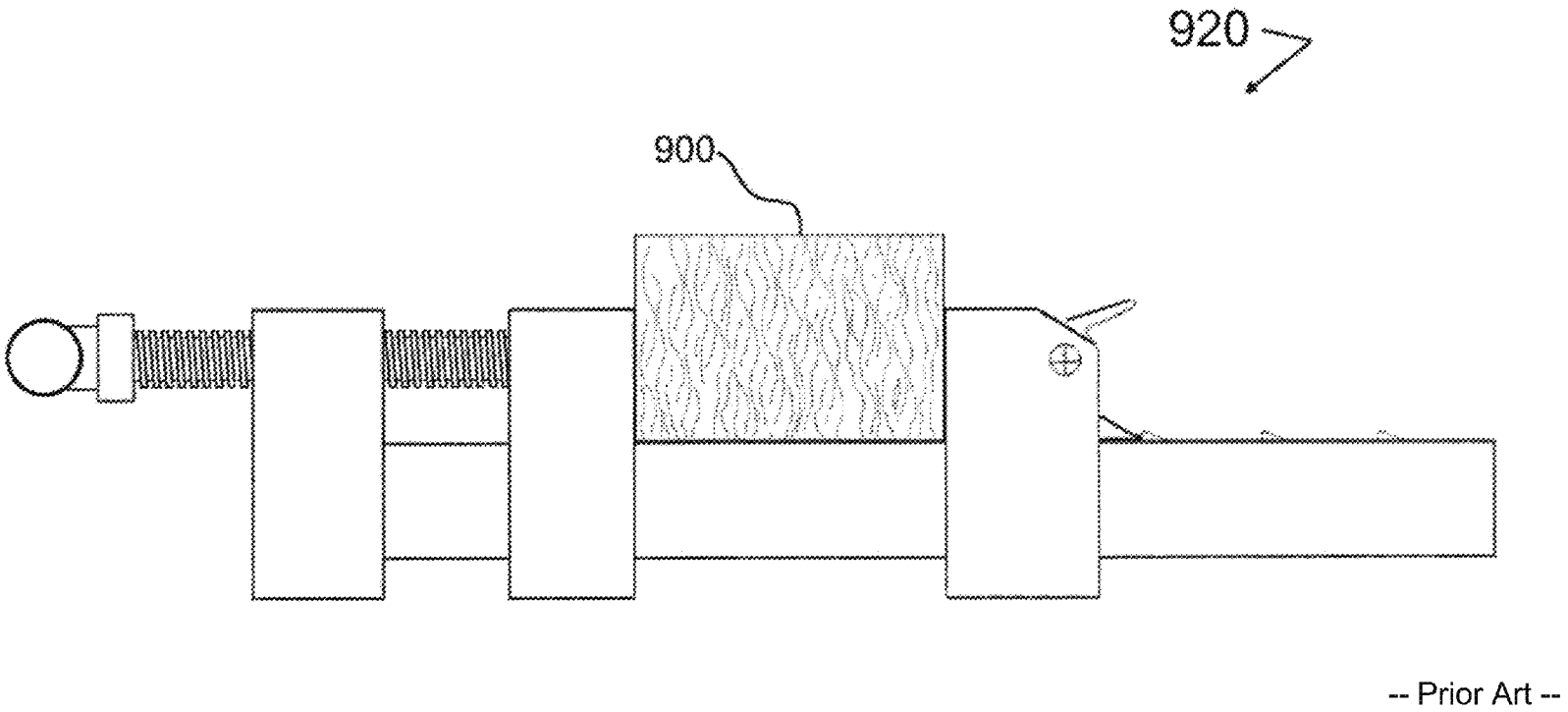
FIG. 6 is a conventional bar clamp in a prior art.

This can be compared to FIG. 6 showing a conventional bar clamp 920.

In the prior art, the threaded base 200, and the jaw bodies 300, 400 are all disposed in the channel 32, not around the straight edge bar 100 as is the prior art shown in FIG. 6.

The channel 32 in the elongated channeled bar 100 is adapted to capture the clamp jaw bodies 300, 400 and threaded base 200. Also, the open channel 32 has side channel(s) 50 which capture, the jaw bodies 300, 400 the threaded base 200 and the threaded shaft 500 there in, in the channel 32 so they are moveable along the length but captured so they cannot lift out.

The clamping mechanism 1000, comprising the combination of the threaded base 200, the jaw bodies 300, 400, and the threaded rod 520, at the threaded edge bar 100 is configured such that the threaded rod 520 is supported by being screwed through the threaded base 200 and anchored rotate-ably at the second movable jaw body 400, while the threaded base 200, and the jaw bodies 300, 400 are disposed partially inside the channel 32 of the straight edge bar 100.

An aspect of the invention provides a straight edge bar with clamp and spreader 2000 as shown in FIGS. 7-18.

The straight edge bar clamp spreader 2000 comprises a straight edge bar 100, an inner channel portion 32, a pair of parallel channel portions 620, a plurality of two-way bosses or divots 360, a clamp 2200, and a clamp-spreader 2400.

Figure 7:
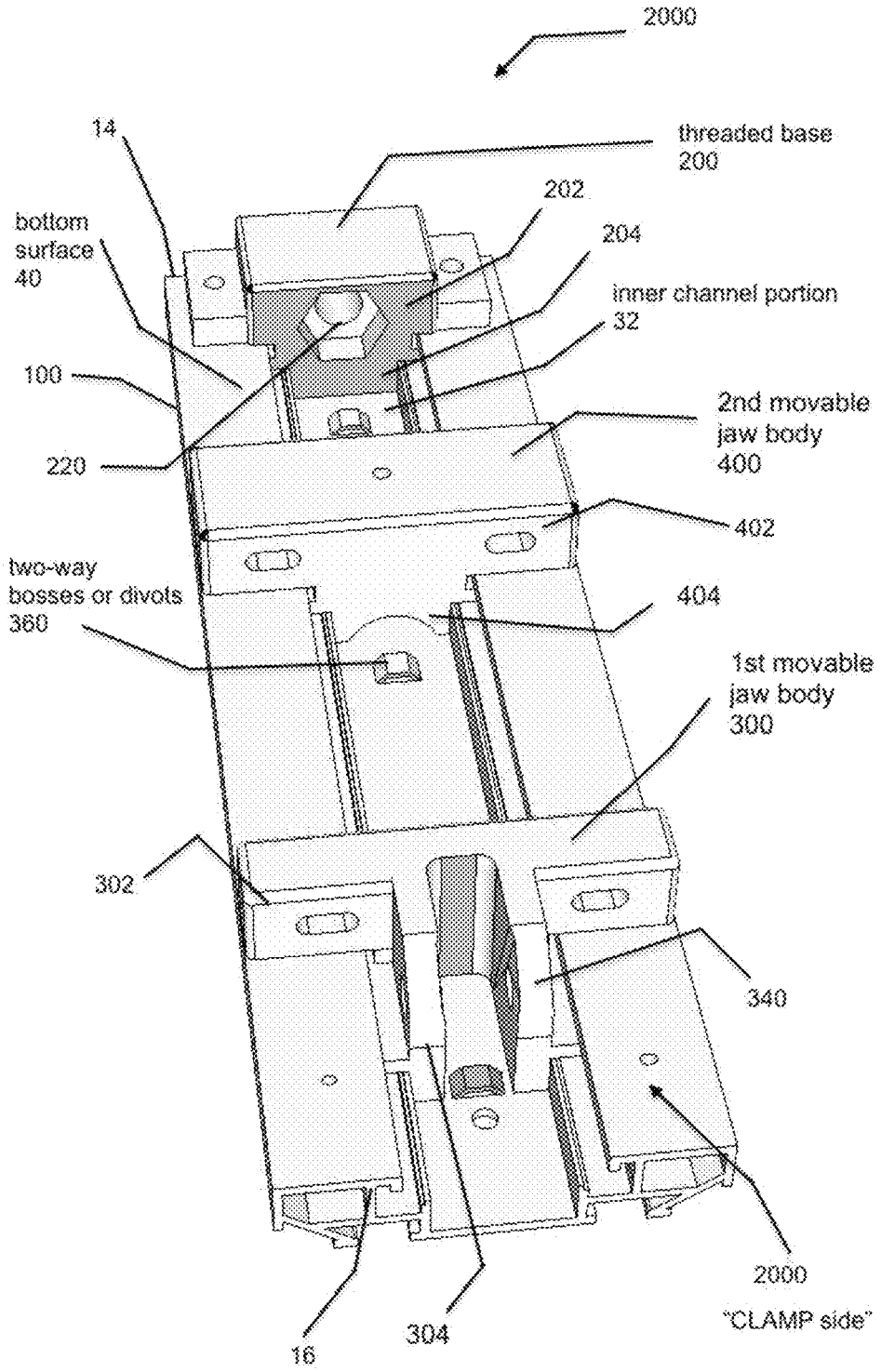
FIG. 7 is a perspective view showing a clamp of a straight edge bar clamp spreader according to the invention.

The straight edge bar 100 comprises an elongated channeled bar having a first end 14, a second end 16, a bottom surface 40, and a top surface 30 as shown in FIGS. 7 and 10.

The inner channel portion 32 is provided along an elongated central region of the bottom surface 40 of the straight edge bar 100 with a constant cross-section as shown in FIGS. 7, 8, 16, and 18.

The pair of parallel channel portions 620 are provided along two elongated parallel regions of the top surface 30 of the straight edge bar 100 with a constant cross-section as shown in FIGS. 9-11, 16, and 17.

The plurality of two-way bosses or divots 360 are provided across and on an inner surface of the inner channel portion 32 of the bottom surface 40 and an outer surface of the top surface 30 and configured to define the plurality of predetermined stopping positions for two-way movements along the inner surface of the bottom surface 40 and/or the outer surface of the top surface 30 as shown in FIGS. 7-15. In the illustrated embodiment, the plurality of two-way bosses or divots 360 emboss on the bottom surface and recess on the top surface. That way, they can provide stopping positions on both sides of the elongated channeled bar at the same time. Of course, they can be provided separately and embossing on both sides or recessing on both sides.

The clamp 2200 is installed in the inner channel portion 32 of the bottom surface as shown in FIGS. 7, 8, and 16-18.

The clamp-spreader 2400 is installed in the pair of parallel channel portions 620 of the top surface 30 as shown in FIGS. 9-11, 16, and 17.

The clamp 2200 and the clamp-spreader 2400 are configured to work independently from each other in sliding and locking.

The clamp 2200 comprises a threaded base 200, a first movable jaw body 300, a catching device 340, a second movable jaw body 400, and a threaded shaft 500 as shown in FIGS. 1, 7, 8, and 16-18. For the clarity, the threaded shaft 500 is not shown except in FIGS. 1, 4, and 5.

The threaded base 200 is installed fixedly partially in the channel 32 of the bottom surface 40 of the elongated channeled bar 100 at the first end 14 of the straight edge bar 100 as shown in FIGS. 1, 4, and 5, but not shown in FIGS. 7-11 and 16-18.

The first movable jaw body 300 is installed movably and partially in the channel 32 of the bottom surface 40 of the elongated channeled bar 100 at a plurality of predetermined positions along the straight edge bar 100, and the plurality of two-way bosses or divots 360 are configured to define the plurality of predetermined stopping positions for the first movable jaw 300.

The catching device 340 is provided in the first movable jaw body 300 and configured to be engaged by or released from one or more of the plurality of two-way bosses or divots 360.

The second movable jaw body 400 is installed partially in the channel 32 of the bottom surface 40 of the elongated channeled bar 100 movably between the threaded base 200 and the first movable jaw body 300 along the bottom surface 40 of the elongated channeled bar 100.

The threaded shaft 500 is disposed in parallel with the straight edge bar 100 and configured to be supported through the threaded base 200 and anchored rotate-ably at the second movable jaw body 400 so as to move the second movable jaw body 400 parallel to and along the straight edge bar 100, so as to exert a clamping force when engaged with a work piece 900 between the moveable jaws 300, 400 as in FIG. 5.

The [elongated channel] bar 100 further comprises a flat top portion 30, straight edge portions 70, a flat bottom portion 40, capturing channel(s) 50, and overhanging portion(s) 60 as shown in FIGS. 2 and 3. In the attached figures, FIGS. 2 and 3 have been marked as - Prior Art -, but their general structure are applied to the ire elongated channeled bar 100 in FIGS. 7-8 and 16-18 of the present invention, especially to the cross-sectional structure of the elongated channeled bar 100.

The capturing channel(s) 50 are provided between the flat top portion 30 and the flat bottom portion 40 and configured inside the inner channeled portion 32 on the bottom surface 40 of the straight edge bar 100 to capture and prevent the threaded base 200, the first movable jaw body 300, and the second movable jaw body 400 from being lifted out of the inner channeled portion 32 of the bottom surface 40 as shown in FIGS. 2, 3, 7, 8, and 16-18.

Each of the overhanging portion(s) 60 may be provided at an inner edge of the flat bottom portion 40 and defining a wall of the corresponding capturing channel 50.

The catching device 340 may comprise a pawl 342, which is configured to be stopped at a catching position so as to be stopped by one or more of the two-way bosses or divots 360 or to be lifted up by a lifted distance larger than a predetermined magnitude so as to clear the two-way bosses or divots 360 and allow the first movable jaw body 300 to slide along the bottom surface 40 of the straight edge bar 100 as shown in FIGS. 1, 4, and 5. As discussed in the above, FIGS. 1, 4, and 5 are also applied to the present invention, for example to FIGS. 7, 8, and 16-18.

Each boss 360 may protrude from the inner surface of the inner channel portion 32 sufficiently to catch the pawl 342 of the catching device, or each divot 360 may be a hollow spot on the inner channel portion 32 of sufficient depth to catch the pawl 342 of the catching device 340.

The threaded base 200 may comprise an outer portion 202 and an inner portion 204, and the outer portion 202 may extend below the flat bottom portion 40, and the inner portion 204 may be disposed and fixed in the channeled portion 32, 50 of the channeled bar 100, surrounded by the flat top portion 30, the capturing channel(s) 50, and the overhanging portion(s) 60 as shown in FIGS. 2, 3, 7, 16.

The threaded shaft 500 may comprise a screw portion 520 supported by a matching threaded screw hole 220 provided through the threaded base 200 as shown in FIGS. 1, 4, 5, and 7.

The threaded shaft 500 may further comprise a handle portion 540 disposed at an end of the screw portion 520, which is farthest from the second jaw body 400 as shown in FIG. 1, which is applicable to the present invention again.

Each of the first and second movable jaw bodies 300, 400 my comprise an outer portion 302, 402 and an inner portion 304, 404, and the outer portion 302, 402 extends below the flat bottom portion 40, and the inner portion 304, 404 may be disposed slide-ably in the channeled portion 32, 50 of the channeled bar 100, surrounded by the flat top portion 30, the capturing channel(s) 50, and the overhanging portion(s) 60 as discussed with respect to the threaded base 200.

The threaded shaft 500 may be disposed partially inside, entirely inside, or entirely outside the straight edge bar 100 with respect to the flat bottom surface 40 in a cross-sectional view.

Each of the plurality of two-way bosses or divots 360 may protrude on the bottom surface 40 and embosses on the top surface 30, and the threaded base 200 may comprise a locking step 230 provided on a bottom side of the threaded base 200 and configured to be latched by one of the plurality of bosses or divots 320. Also, the threaded base 200 may further comprise one or more holes 231 through the threaded base 200 and the straight edge bar 100 may further comprise corresponding holes 361, so that one or more screws or fasteners (not shown) fasten the thread base 200 to the straight edge bar 100 as shown in FIG. 8.

As discussed in the above, the catching device 340 may comprise a pawl 342. Alternatively, however, the catching device 340 may comprise an one-way latching groove (not shown) like the locking step 230 provided on a bottom side of the threaded base 200 and configured to be latched by one of the plurality of two-way bosses or divots 360.

Figure 9:
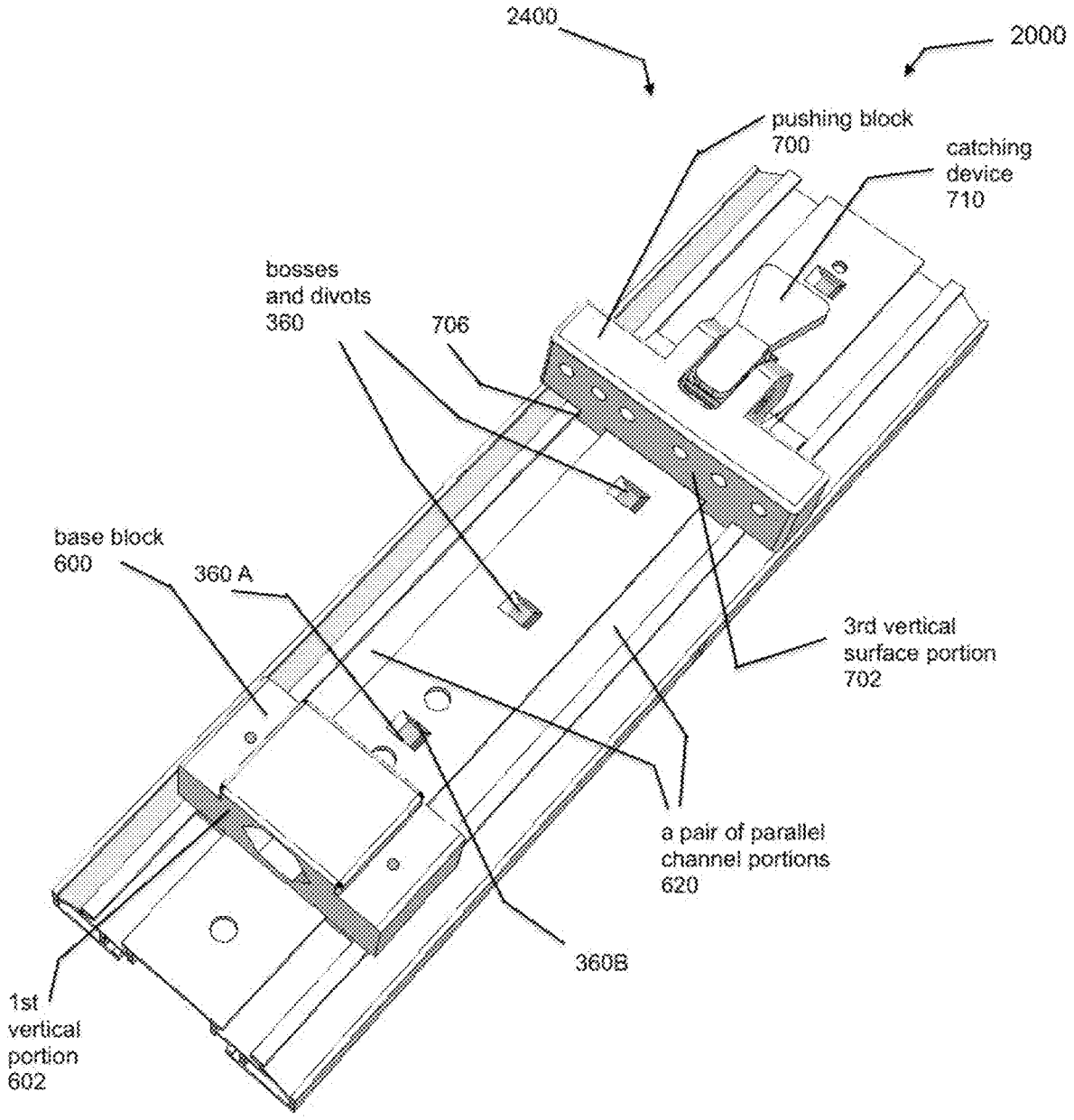
FIG. 9 is a perspective view showing a clamp-spreader of a straight edge bar clamp according to an embodiment of the invention.

The clamp-spreader 2400 may comprise a base block 600 and a pushing block 700 as shown in FIGS. 9 and 10.

The base block 600 comprises a first vertical surface portion 602, a second vertical surface portion 604, a pair of guiding protrusions 606, and a latching portion 608, wherein each of the pair of guiding protrusions 606 is configured to be received and guided by one of the pair of parallel channel portions 620, and the latching portion 608 is configured to be received and latched by one of the plurality of two-way bosses or divots 360 as shown in FIGS. 9 and 10.

The pushing block 700 comprises a third vertical surface portion 702, a pair of guiding protrusions 706, and a catching device 710, and each of the pair of guiding protrusions 706 is configured to be received and guided by one of the pair of parallel channel portions 620, and the catching device 710 is provided in the pushing block 700 and configured to be engaged by or released from one of the plurality of two-way bosses or divots 360 as shown in FIGS. 9, 10, 16, and 17.

Each of the first and second vertical surface portions 602, 604 is configured to be used to engage a work piece 900 with the third vertical surface portion 702.

The catching device 710 may comprise a pawl 342, which is configured to be stopped at a catching position so as to be stopped by one or more of the two-way bosses or divots 360 or to be lifted up by a lifted distance larger than a predetermined magnitude so as to clear the two-way bosses or divots 360 and allow the pushing block 700 to slide along the top surface 30 of the straight edge bar 100 in the same manner as in FIG. 1, which is also applicable to the present invention.

The pair of guiding protrusions 706 of the pushing block 700 and the catching device 710 may be configured so that the pushing block 700 is disposed in both directions with the third vertical surface portion 702 disposed inwards or outwards as shown in FIGS. 9 and 10.

The pair of guiding protrusions 606 of the base block 600 and the latching portion 608 may be configured so that the base block 600 is disposed in both directions with the first or second vertical surface portion 602, 604 disposed inwards as shown in FIGS. 9 and 10.

FIGS. 19-22 show a straight edge bar clamp spreader assembled with a threaded shaft installed and configured for a clamp on each of the top and bottom surfaces according to an embodiment of the invention.

Figure 23:
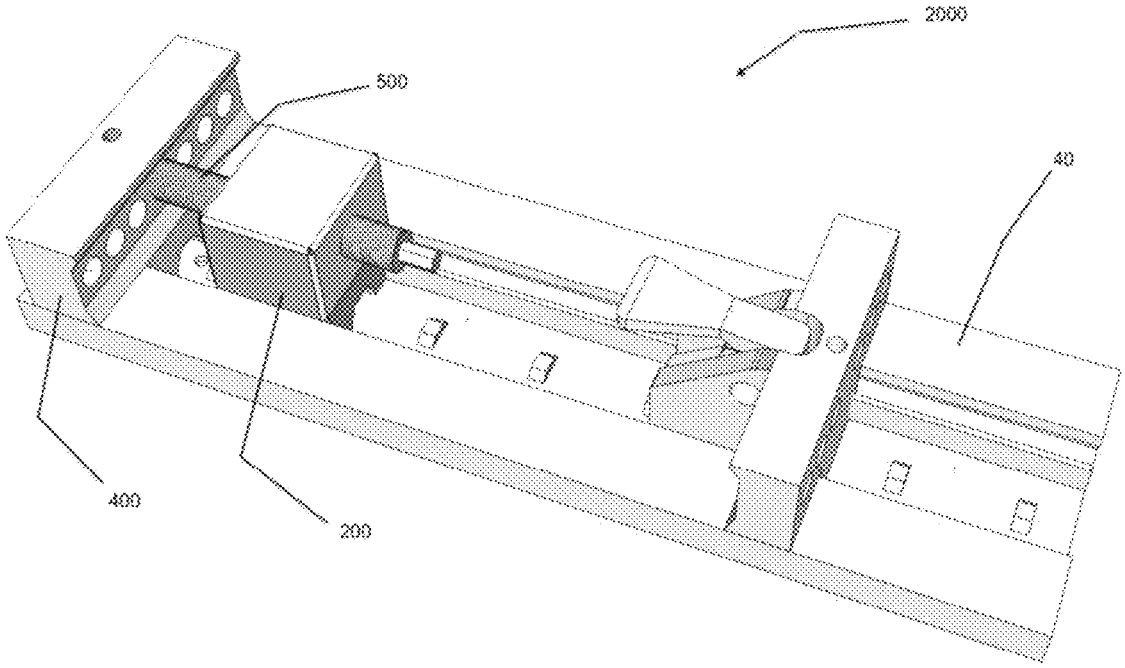
FIG. 23 is a perspective view showing a clamp side of a straight edge bar clamp spreader assembled with a threaded shaft installed and configured for a spreader on the bottom side according to an embodiment of the invention.
Figure 24:
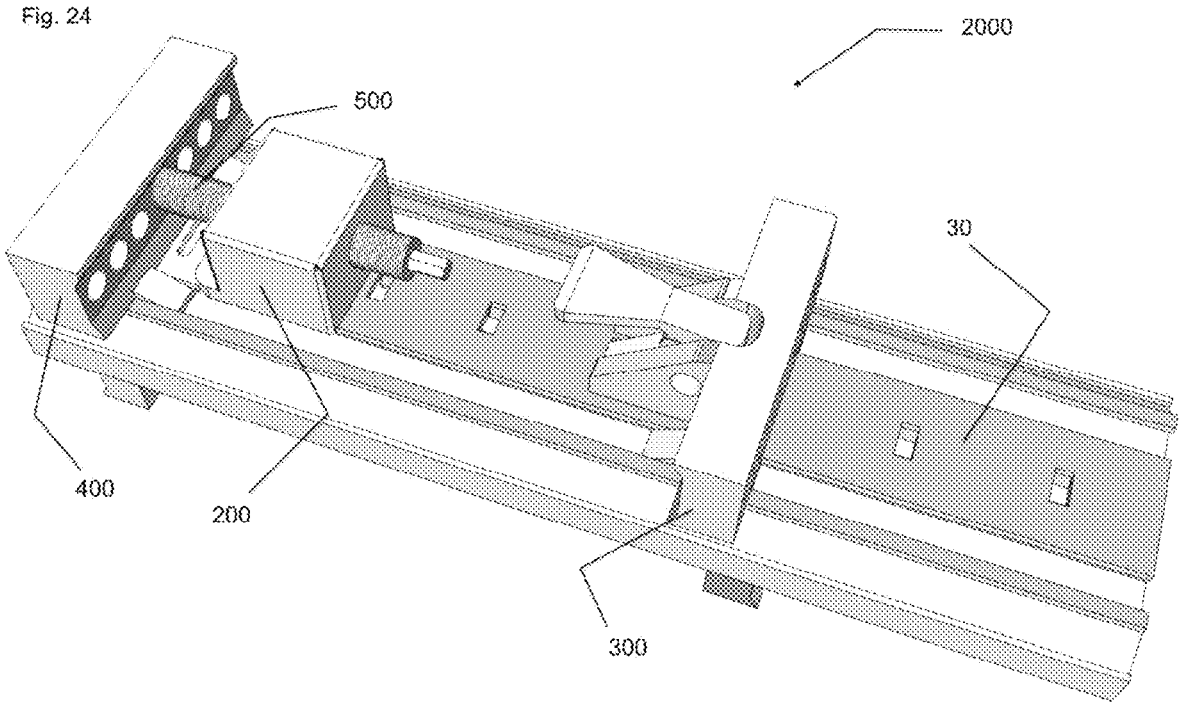
FIG. 24 is a perspective view showing a spreader side of a straight edge bar clamp spreader assembled with a threaded shaft installed and configured for a spreader on the top side according to an embodiment of the invention.

FIGS. 23-24 show a straight edge bar clamp spreader assembled with a threaded shaft installed and configured for a spreader on each of the top and bottom surfaces according to an embodiment of the invention.

As shown in FIGS. 19-24, each of the top side and the bottom side can be used independently, and also as a clamp or a spreader according to the direction of disposing and installing of the threaded base 200 or the base block 600.

For the above features, the shape of each of the plurality of two-way bosses or divots 360 have two stopping steps 360A, 360B as shown in FIGS. 9 and 11.

Figure 20:
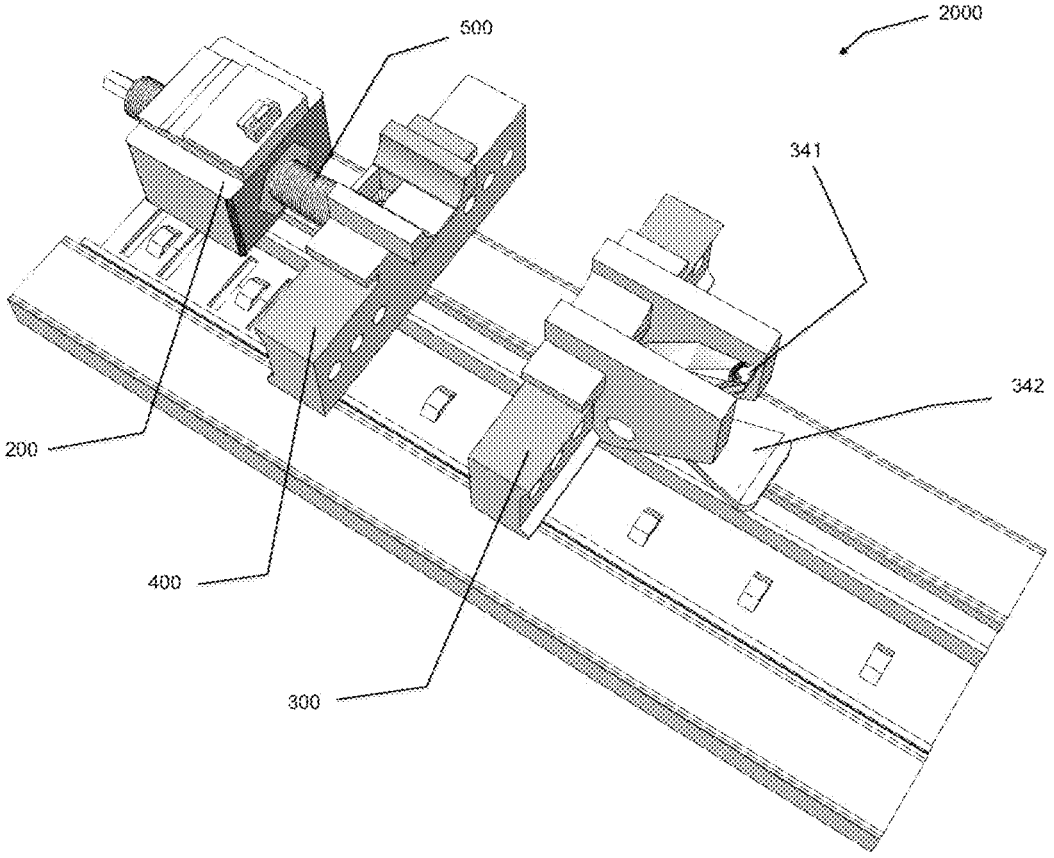
FIG. 20 is a perspective view showing the straight edge bar clamp spreader of FIG. 19 with the moving parts disassembled and disposed upside down.
Figure 22:
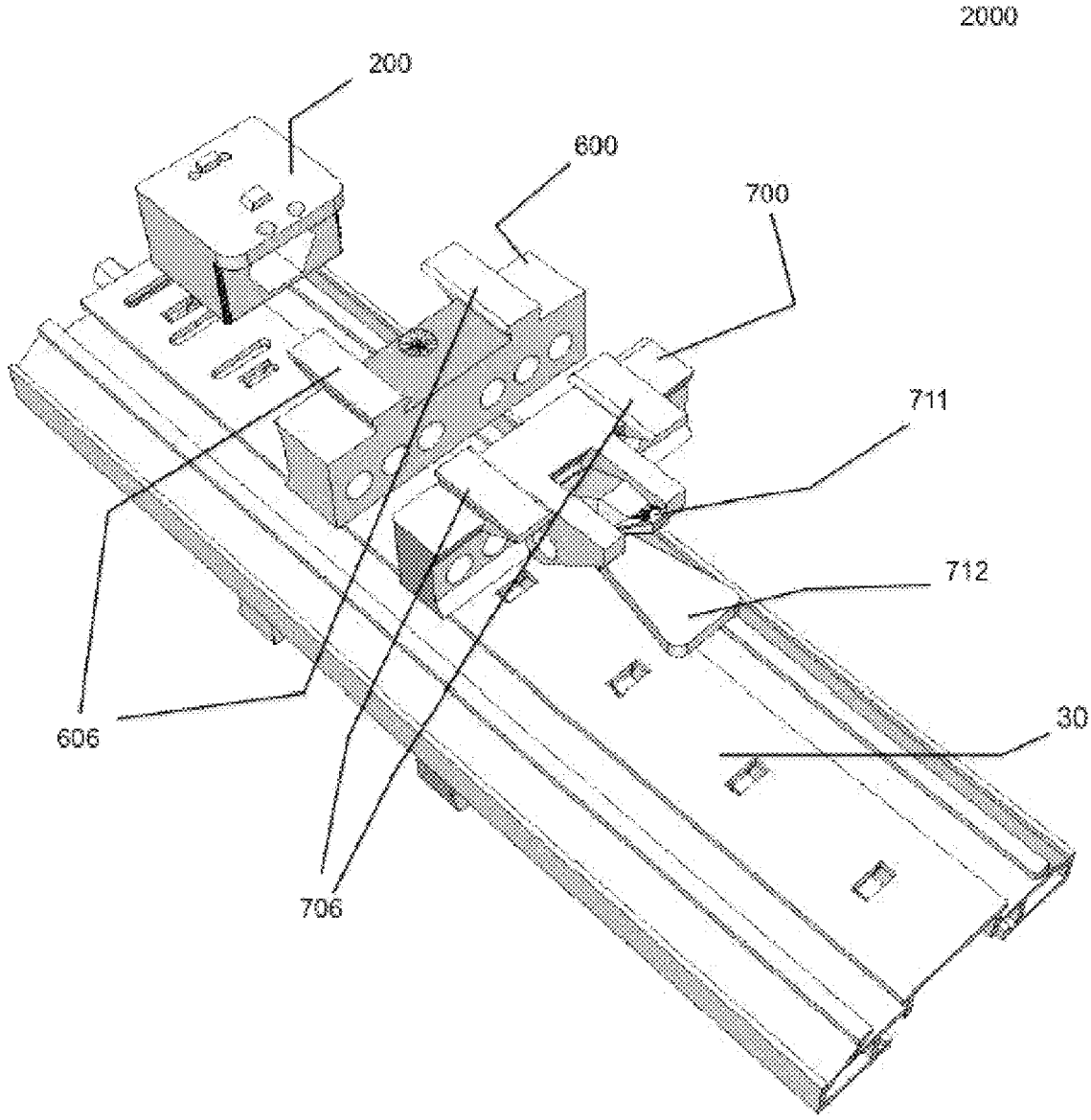
FIG. 22 is a perspective view showing a spreader side of a straight edge bar clamp spreader of FIG. 21 with the moving parts disassembled and disposed upside down.

In certain embodiments of the invention, the catching devices 340, 710 may have catching protrusions 341, 711, respectively, which can be lifted and lowered by handles 342, 712 connected with a hinge structure as shown in FIGS. 20 and 22.

Figure 21:
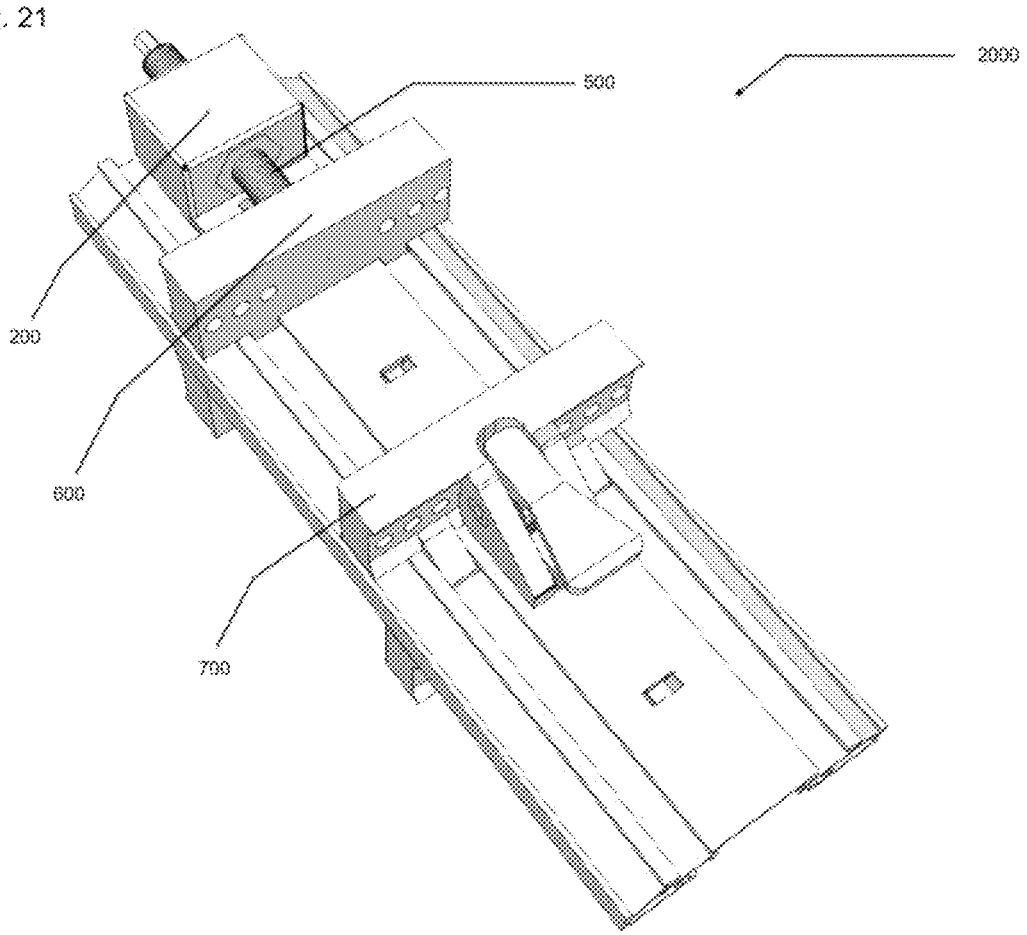
FIG. 21 is a perspective view showing a spreader side of a straight edge bar clamp spreader assembled with a threaded shaft installed according to an embodiment of the invention.

In certain embodiments of the invention as shown in FIGS. 21, 22, and 24, the clamp-spreader 2400 may further comprise: a threaded base 200 disposed on the top surface 30 of the elongated channeled bar at the first end 14 of the straight edge bar 100; and a threaded shaft 500 disposed in parallel with the straight edge bar 100 and configured to be supported through the threaded base 200 and anchored rotate-ably at the base block 600 so as to move the base block 600 parallel to and along the straight edge bar 100, so as to exert a clamping force when engaged with a work piece 900 between the base block 600 and the pushing block 700.

Each of the plurality of two-way bosses or divots 360 may comprise two stopping steps 360A, 360B configured for stopping the catching device 340, 710 of the clamp or the clamp-spreader on the bottom surface 40 or the top surface 30, respectively as shown in FIGS. 9 and 11.

In the above embodiment of the invention, the threaded base 200 and the base block 600 connected to each other through the threaded shaft 500 may be configured to be disposed in a reverse direction and the pushing block 700 may be configured to be disposed in the reverse direction, so as to form and work as a spreader as shown in FIG. 24, in contrast to working as a clamp as shown in FIG. 21.

Figure 19:
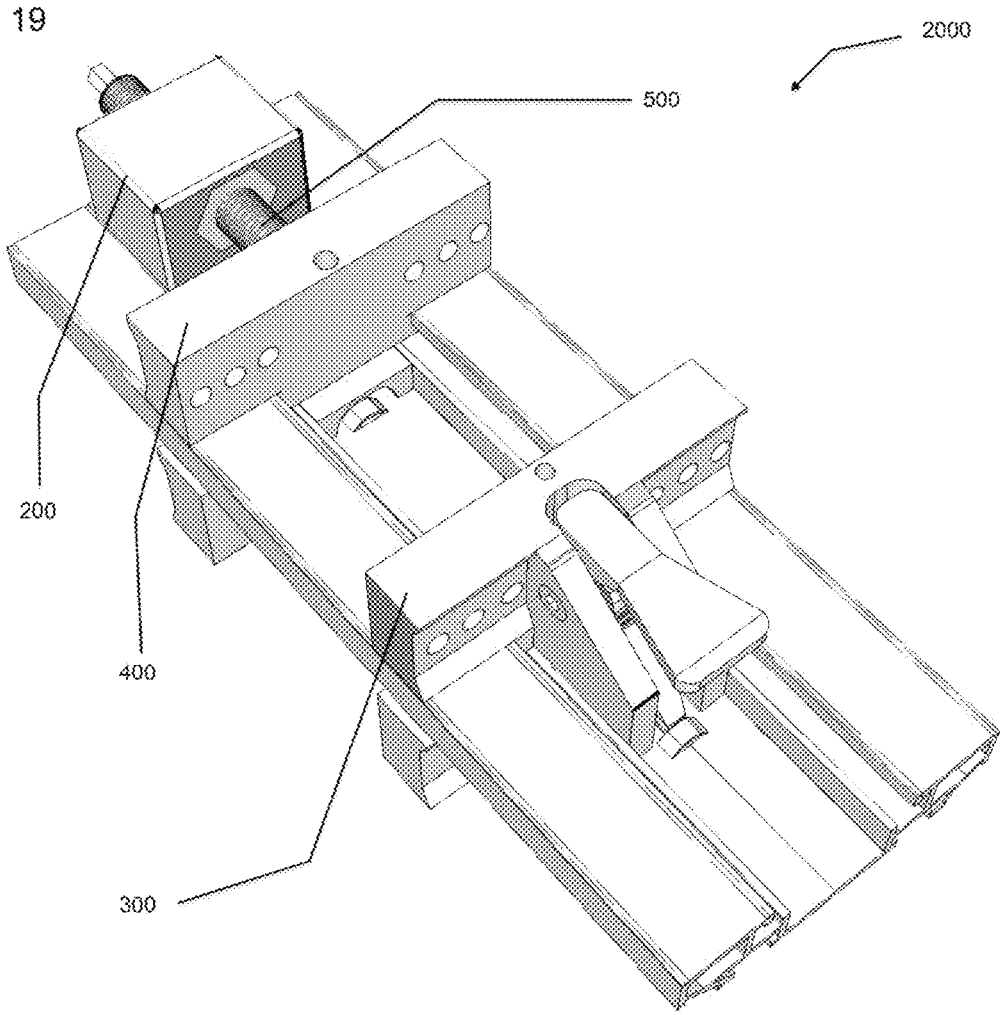
FIG. 19 is a perspective view showing a clamp side of a straight edge bar clamp spreader assembled with a threaded shaft installed according to an embodiment of the invention.

Similarly, in certain embodiments of the invention, the threaded base 200 and the second movable jaw body 400 connected to each other through the threaded shaft 500 may be configured to be disposed in a reverse direction and the first movable jaw body 300 may be configured to be disposed in the reverse direction, so as to form a spreader as shown in FIG. 23, in contrast to working as a clamp as shown in FIG. 19.

With the above structures, the pushing block 700 may be called as a sliding jaw or sliding block, and it can be slid along the pair of parallel channel portions 620 by hand to a position and cause the clamping or spreading action.

Similarly, especially shown in FIGS. 19-24, the elements 300, 400, 600, and 700 can slide in a length direction of the straight edge bar 100 due to the structures of elements 32, 304, 620, 606, 706. Each of the first movable jaw body 300 and the second movable jaw body 400 includes the similar structure as the element 304. Each of the base block 600 and the pushing block 700 also has the similar structure as the elements 606 and 706.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A straight edge bar clamp spreader comprising:

a straight edge bar comprising an elongated channeled bar having a first end, a second end, a bottom surface, and a top surface;

an inner channel portion provided along an elongated central region of the bottom surface of the straight edge bar with a constant cross-section;

a pair of parallel channel portions provided along two elongated parallel regions of the top surface of the straight edge bar with a constant cross-section;

a plurality of two-way bosses or divots provided across and on an inner surface of the inner channel portion of the bottom surface and an outer surface of the top surface and configured to define the plurality of predetermined stopping positions for two-way movements along the inner surface of the bottom surface or the outer surface of the top surface;

a clamp comprising the elongated channeled bar and the straight edge bar located adjacent the inner channel portion of the bottom surface;

a clamp-spreader installed in the pair of parallel channel portions of the top surface, wherein the clamp and the clamp-spreader are configured to work independently from each other in sliding and locking;

a threaded base installed fixedly partially in the channel of the bottom surface of the elongated channeled bar at the first end of the straight edge bar;

a first movable jaw body installed movably and partially in the channel of the bottom surface of the elongated channeled bar at a plurality of predetermined positions along the straight edge bar, wherein the plurality of two-way bosses or divots are configured to define the plurality of predetermined stopping positions for the first movable jaw;

a catching device provided in the first movable jaw body and configured to be engaged by or released from one or more of the plurality of two-way bosses or divots;

a second movable jaw body installed partially in the channel of the bottom surface of the elongated channeled bar movably between the threaded base and the first movable jaw body along the bottom surface of the elongated channeled bar; and a threaded shaft disposed in parallel with the straight edge bar and configured to be supported through the threaded base and anchored rotate-ably at the second movable jaw body so as to move the second movable jaw body parallel to and along the straight edge bar, so as to exert a clamping force when engaged with a work piece between the moveable jaws;

wherein the elongated channeled bar further comprises:

a flat top portion;

straight edge portions;

a flat bottom portion;

capturing channel(s) provided between the flat top portion and the flat bottom portion and configured inside the inner channeled portion on the bottom surface of the straight edge bar to capture and prevent the threaded base, the first movable jaw body, and the second movable jaw body from being lifted out of the inner channeled portion of the bottom surface; and overhanging portion(s), each of which being provided at an inner edge of the flat bottom portion and defining a wall of the corresponding capturing channel.

2. The straight edge bar clamp spreader of claim 1, wherein each boss protrudes from the inner surface of the inner channel portion sufficiently to catch the pawl of the catching device, or each divot may be a hollow spot on the inner channel portion of sufficient depth to catch the pawl of the catching device.

3. The straight edge bar clamp spreader of claim 1, wherein the threaded base comprises an outer portion and an inner portion, wherein the outer portion extends below the flat bottom portion, and wherein the inner portion is disposed and fixed in the channeled portion of the channeled bar, surrounded by the flat top portion, the capturing channel (s), and the overhanging portion(s).

4. The straight edge bar clamp spreader of claim 1, wherein the threaded shaft comprises a screw portion supported by a matching threaded screw hole provided through the threaded base.

5. The straight edge bar clamp spreader of claim 4, wherein the threaded shaft further comprises a handle portion disposed at an end of the screw portion, which is farthest from the second jaw body.

6. The straight edge bar clamp spreader of claim 1, wherein each of the first and second movable jaw bodies comprises an outer portion and an inner portion, wherein the outer portion extends below the flat bottom portion, and wherein the inner portion is disposed slide-ably in the channeled portion of the channeled bar, surrounded by the flat top portion, the capturing channel(s), and the overhanging portion(s).

7. The straight edge bar clamp spreader of claim 1, wherein the threaded shaft is disposed partially inside, entirely inside, or entirely outside the straight edge bar.

8. The straight edge bar clamp spreader of claim 1, wherein the clamp-spreader comprises:

a base block comprising a first vertical surface portion, a second vertical surface portion, a pair of guiding protrusions, and a latching portion, wherein each of the pair of guiding protrusions is configured to be received and guided by one of the pair of parallel channel portions, wherein the latching portion is configured to be received and latched by one of the plurality of two-way bosses or divots; and a pushing block comprising a third vertical surface portion, a pair of guiding protrusions, and a catching device, wherein each of the pair of guiding protrusions is configured to be received and guided by one of the pair of parallel channel portions, and wherein the catching device is provided in the pushing block and configured to be engaged by or released from one of the plurality of two-way bosses or divots, wherein each of the first and second vertical surface portions is configured to be used to engage a work piece with the third vertical surface portion.

9. A straight edge bar clamp spreader comprising:

a straight edge bar comprising an elongated channeled bar having a first end, a second end, a bottom surface, and a top surface;

an inner channel portion provided along an elongated central region of the bottom surface of the straight edge bar with a constant cross-section;

a pair of parallel channel portions provided along two elongated parallel regions of the top surface of the straight edge bar with a constant cross-section;

a plurality of two-way bosses or divots provided across and on an inner surface of the inner channel portion of the bottom surface and an outer surface of the top surface and configured to define the plurality of predetermined stopping positions for two-way movements along the inner surface of the bottom surface or the outer surface of the top surface;

a clamp comprising the elongated channeled bar and the straight edge bar located adjacent the inner channel portion of the bottom surface;

a clamp-spreader installed in the pair of parallel channel portions of the top surface, wherein the clamp and the clamp-spreader are configured to work independently from each other in sliding and locking;

wherein the clamp-spreader comprises:

a base block comprising a first vertical surface portion, a second vertical surface portion, a pair of guiding protrusions, and a latching portion, wherein each of the pair of guiding protrusions is configured to be received and guided by one of the pair of parallel channel portions, wherein the latching portion is configured to be received and latched by one of the plurality of two-way bosses or divots; and a pushing block comprising a third vertical surface portion, a pair of guiding protrusions, and a catching device, wherein each of the pair of guiding protrusions is configured to be received and guided by one of the pair of parallel channel portions, and wherein the catching device is provided in the pushing block and configured to be engaged by or released from one of the plurality of two-way bosses or divots, wherein each of the first and second vertical surface portions is configured to be used to engage a work piece with the third vertical surface portion; and wherein the catching device comprises a pawl, which is configured to be stopped at a catching position so as to be stopped by one or more of the two-way bosses or divots or to be lifted up by a lifted distance larger than a predetermined magnitude so as to clear the two-way bosses or divots and allow the pushing block to slide along the top surface of the straight edge bar.

10. The straight edge bar clamp spreader of claim 9, wherein the pair of guiding protrusions of the pushing block and the catching device are configured so that the pushing block is disposed in both directions with the third vertical surface portion disposed inwards or outwards.

11. The straight edge bar clamp spreader of claim 10, wherein the pair of guiding protrusions of the base block and the latching portion are configured so that the base block is disposed in both directions with the first or second vertical surface portion disposed inwards.

12. The straight edge bar clamp spreader of claim 9, wherein the clamp-spreader further comprises: a threaded base disposed on the top surface of the elongated channeled bar at the first end of the straight edge bar; and a threaded shaft disposed in parallel with the straight edge bar and configured to be supported through the threaded base and anchored rotate-ably at the base block so as to move the base block parallel to and along the straight edge bar, so as to exert a clamping force when engaged with a work piece between the base block and the pushing block.

13. The straight edge bar clamp spreader of claim 9, wherein each of the plurality of two-way bosses or divots comprises two stopping steps configured for stopping the catching device of the clamp or the spreader on the bottom surface or the top surface, respectively.

14. The straight edge bar clamp spreader of claim 13, wherein a threaded base and the base block connected to each other through a threaded shaft are configured to be disposed in a reverse direction and the pushing block is configured to be disposed in the reverse direction, so as to form a clamp or a spreader.

15. The straight edge bar clamp spreader of claim 13, wherein a threaded base and a second movable jaw body connected to each other through a threaded shaft are configured to be disposed in a reverse direction and a first movable jaw body is configured to be disposed in the reverse direction, so as to form a clamp or a spreader.

16. A straight edge bar clamp spreader comprising:

a straight edge bar comprising an elongated channeled bar having a first end, a second end, a bottom surface, and a top surface;

an inner channel portion provided along an elongated central region of the bottom surface of the straight edge bar with a constant cross-section;

a pair of parallel channel portions provided along two elongated parallel regions of the top surface of the straight edge bar with a constant cross-section;

a plurality of two-way bosses or divots provided across and on an inner surface of the inner channel portion of the bottom surface and an outer surface of the top surface and configured to define the plurality of predetermined stopping positions for two-way movements along the inner surface of the bottom surface or the outer surface of the top surface;

a clamp comprising the elongated channeled bar and the straight edge bar located adjacent the inner channel portion of the bottom surface;

a clamp-spreader installed in the pair of parallel channel portions of the top surface, wherein the clamp and the clamp-spreader are configured to work independently from each other in sliding and locking;

a threaded base installed fixedly partially in the channel of the bottom surface of the elongated channeled bar at the first end of the straight edge bar;

a first movable jaw body installed movably and partially in the channel of the bottom surface of the elongated channeled bar at a plurality of predetermined positions along the straight edge bar, wherein the plurality of two-way bosses or divots are configured to define the plurality of predetermined stopping positions for the first movable jaw;

a catching device provided in the first movable jaw body and configured to be engaged by or released from one or more of the plurality of two-way bosses or divots;

a second movable jaw body installed partially in the channel of the bottom surface of the elongated channeled bar movably between the threaded base and the first movable jaw body along the bottom surface of the elongated channeled bar; and a threaded shaft disposed in parallel with the straight edge bar and configured to be supported through the threaded base and anchored rotate-ably at the second movable jaw body so as to move the second movable jaw body parallel to and along the straight edge bar, so as to exert a clamping force when engaged with a work piece between the moveable jaws;

wherein the catching device comprises a pawl, which is configured to be stopped at a catching position so as to be stopped by one or more of the two-way bosses or divots or to be lifted up by a lifted distance larger than a predetermined magnitude so as to clear the two-way bosses or divots and allow the first movable jaw body to slide along the bottom surface of the straight edge bar.

17. The straight edge bar clamp spreader of claim 16, wherein the threaded base comprises an outer portion and an inner portion, wherein the outer portion extends below a flat bottom portion, and wherein the inner portion is disposed and fixed in the channeled portion of the channeled bar, surrounded by a flat top portion, the capturing channel(s), and the overhanging portion(s).

18. The straight edge bar clamp spreader of claim 16, wherein the threaded shaft comprises a screw portion supported by a matching threaded screw hole provided through the threaded base.

* * * * *